US009303508B2

(12) United States Patent
Ramakrishnan et al.

(10) Patent No.: US 9,303,508 B2
(45) Date of Patent: Apr. 5, 2016

(54) IN-SITU STRESS MEASUREMENTS IN HYDROCARBON BEARING SHALES

(75) Inventors: Hariharan Ramakrishnan, Sugar Land, TX (US); George Waters, Oklahoma City, OK (US); Edward C. Boratko, Sugar Land, TX (US); Ahmad Latifzal, Houston, TX (US); Doug Bentley, Warsaw (PL)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 1180 days.

(21) Appl. No.: 13/144,463

(22) PCT Filed: Jan. 12, 2010

(86) PCT No.: PCT/US2010/020778

§ 371 (c)(1),
(2), (4) Date: Mar. 1, 2012

(87) PCT Pub. No.: WO2010/083166

PCT Pub. Date: Jul. 22, 2010

(65) Prior Publication Data

US 2012/0150515 A1 Jun. 14, 2012

Related U.S. Application Data

(60) Provisional application No. 61/144,342, filed on Jan. 13, 2009.

(51) Int. Cl.
*G06G 7/48* (2006.01)
*G06G 7/50* (2006.01)
(Continued)

(52) U.S. Cl.
CPC ..... *E21B 49/008* (2013.01); *E21B 33/124* (2013.01); *E21B 49/006* (2013.01)

(58) Field of Classification Search
CPC . G06F 2217/16; E21B 33/122; E21B 33/124; E21B 33/1272; E21B 33/12; E21B 49/006; E21B 49/008; E21B 49/00; E21B 43/00; E21B 47/0006; G01V 2200/16; G01V 2210/1216; G01V 11/00; G01V 1/48
USPC ..... 703/7, 9, 10; 702/6, 9, 11, 14, 42
See application file for complete search history.

(56) References Cited

U.S. PATENT DOCUMENTS 5,353,637 A 10/1994 Plumb et al.
5,555,945 A * 9/1996 Schultz et al. ..... 175/50
(Continued)

OTHER PUBLICATIONS

Carnegie, A. et al, "An Advanced Method of Determining Insitu Reservoir Stresses: Wireline Conveyed Micro-Fracturing", presented at the 10th Abu Dhabi International Petroleum Exhibition and Conference, SPE 78486, 2002, pp. 1-16.
(Continued)

*Primary Examiner* — Kamini S Shah
*Assistant Examiner* — Andre Pierre Louis
(74) *Attorney, Agent, or Firm* — Kenneth L. Kincaid

(57) ABSTRACT

Example in-situ stress measurements in hydrocarbon bearing shales are disclosed. A disclosed example method includes lowering a downhole tool into a wellbore penetrating a subterranean shale formation, logging via the downhole tool, a portion of the wellbore adjacent the shale formation to generate logging results, processing the logging results to select test intervals along the portion of the wellbore, performing a stress test at one or more of the selected test intervals to generate stress test results for the shale formation, and adjusting a model representing at least one property of the shale formation based on the stress test results.

17 Claims, 22 Drawing Sheets

(51) Int. Cl.
*E21B 49/00* (2006.01)
*E21B 33/124* (2006.01)

(56) References Cited

U.S. PATENT DOCUMENTS

| | | | | |
|---|---|---|---|---|
| 6,986,282 | B2 | 1/2006 | Ciglenec et al. | |
| 7,135,231 | B1 * | 11/2006 | Sinclair et al. | 428/407 |
| 7,983,885 | B2 | 7/2011 | Suarez-Rivera et al. | |
| 7,996,199 | B2 | 8/2011 | Sayers et al. | |
| 2004/0237640 | A1 | 12/2004 | Meister et al. | |
| 2007/0162235 | A1 * | 7/2007 | Zhan et al. | 702/6 |
| 2007/0246649 | A1 * | 10/2007 | Jacobi et al. | 250/269.6 |
| 2007/0294034 | A1 * | 12/2007 | Bratton et al. | 702/6 |
| 2009/0164129 | A1 * | 6/2009 | Sayers | 702/11 |

OTHER PUBLICATIONS

Ramakrishnan, H. et al, "Application of Downhole Injection Stress Testing in the Barnett Shale Formation", presented at 2009 SPE Annual Technical Conference and Exhibition, held in New Orleans, LA, Oct. 4-7, 2009, SPE 124147, pp. 1-13.

Thiercelin, M. et al, "A New Wireline Tool for In-Situ Stress Measurements", SPE 25906, SPE Formation Evaluation, Mar. 1996, pp. 19-25.

Thiercelin, M. et al, "Open Hole Stress Tests in Shales", presented at the 1994 Eurock SPE/ISRM Rock Mechanics in Petroleum Engineering Conference held in Delft, The Netherlands, Aug. 29-31, 1994, pp. 921-928.

* cited by examiner

IN-SITU STRESS MEASUREMENTS IN HYDROCARBON BEARING SHALES

RELATED APPLICATION

This application claims the benefit of U.S. Provisional Application 61/144,342, filed Jan. 13, 2009, the entirety of which is hereby incorporated by reference.

BACKGROUND

Wellbores are drilled to, for example, locate and produce hydrocarbons within subterranean rock formations. During a drilling operation, it may be desirable to perform evaluations of the formations penetrated and/or encountered formation fluids and/or gasses. In some cases, a drilling tool is removed and a wireline tool is then deployed into the wellbore to test and/or sample the formation, and/or gasses and fluids associated with the formation. In other cases, the drilling tool may be provided with devices to test and/or sample the surrounding formation, formation gasses and/or formation fluids without having to remove the drilling tool from the wellbore. These samples or tests may be used, for example, to characterize hydrocarbons extracted from the formation.

Figure 1:
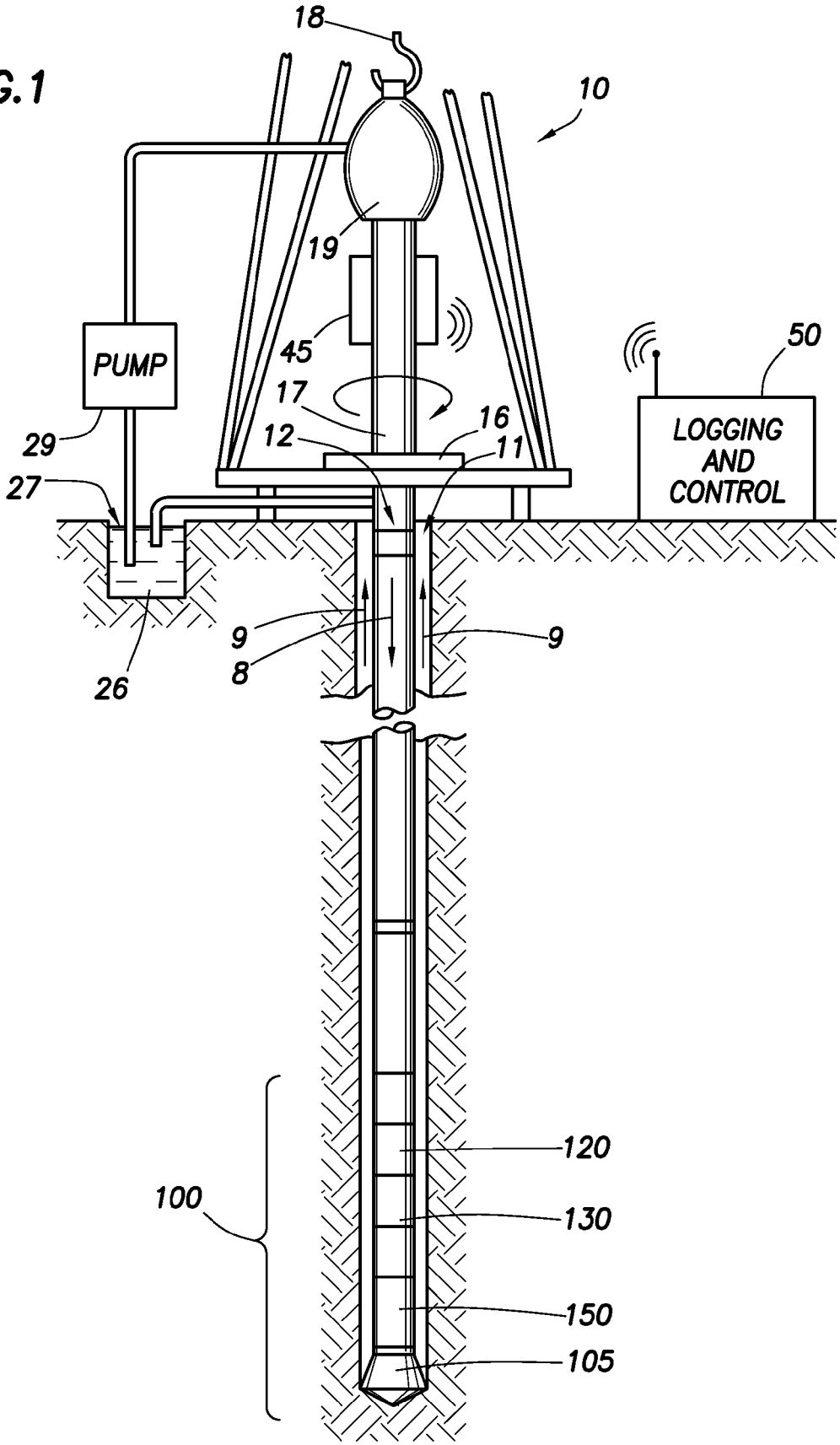
FIG. 1 depicts a partial cross-sectional view of an example wellsite drilling system including a downhole module according to one or more aspects of the present disclosure.

Certain examples are shown in the above-identified figures and described in detail below. In describing these examples, like or identical reference numbers may be used to identify common or similar elements. The figures are not necessarily to scale and certain features and certain views of the figures may be shown exaggerated in scale or in schematic for clarity and/or conciseness. Moreover, while certain preferred embodiments are disclosed herein, other embodiments may be utilized and structural changes may be made without departing from the scope of the invention.

DETAILED DESCRIPTION

The example methods, apparatus, and systems described herein may be used to perform stress measurements in subterranean hydrocarbon-bearing shale formations. The example methods, apparatus, and systems may lower a downhole tool into a wellbore that penetrates a subterranean shale formation. The example downhole tool may be configured to log all or a portion of the wellbore adjacent the shale formation to generate logging results. The logging results may include measurements of petrophysical properties of the shale formation. The example methods, systems, and apparatus may then process the logging results to select test intervals along the portion of the wellbore. Processing the logging results may include, for example, performing a petrophysical analysis and/or a cluster analysis on the logging results. Based on the processed logging results, the example methods, apparatus, and systems may identify one or more test intervals having petrophysical properties or characteristics conducive to fracturing and further testing and/or, ultimately, hydrocarbon production.

The example methods, apparatus, and systems may further determine an anticipated or estimated pressure needed to fracture each of the identified test intervals. Based on the anticipated pressure, the example methods, apparatus, and systems may sequence testing of the test intervals from lower anticipated pressures to higher anticipated pressures. If the anticipated pressure for any of the selected test intervals is sufficiently high, the example methods, apparatus, and systems may perform one or more operations (e.g., via coring, perforation, etc.) on the wellbore wall adjacent the formation to reduce the pressure required to fracture the formation at those test intervals.

The example methods, apparatus, and systems may then perform in-situ stress-testing on each of the test intervals in the testing sequence. In-situ stress-testing may be performed, for example, by inflating packers on both sides of a pressure interval. The example methods, apparatus, and systems may then pump fluid into the pressure interval to increase the pressure on the formation until the formation fractures. When the formation fractures, the example methods, apparatus, and systems may collect pressure data corresponding to the formation fracture. Additional information associated with the fracture may be collected after a fracture is created at each test interval. The pressure data and/or other data may then be used to improve the accuracy of a stress model and/or a fracture simulator to improve production of hydrocarbons from the well.

FIG. 1 illustrates an example wellsite drilling system that can be employed onshore and/or offshore and which may embody aspects of the present disclosure. In the example wellsite system of FIG. 1, a wellbore 11 is formed in one or more subsurface formations by rotary and/or directional drilling. In the illustrated example of FIG. 1, a drillstring 12 is suspended within the wellbore 11 and has a bottomhole assembly (BHA) 100 having a drill bit 105 at its lower end. A surface system includes a platform and derrick assembly 10 positioned over the wellbore 11. The assembly 10 includes a rotary table 16, a kelly 17, a hook 18 and a rotary swivel 19. The drillstring 12 is rotated by the rotary table 16, energized by means not shown, which engages the kelly 17 at the upper end of the drillstring 12. The example drillstring 12 is suspended from the hook 18, which is attached to a traveling block (not shown), and through the kelly 17 and the rotary swivel 19, which permits rotation of the drillstring 12 relative to the hook 18. Additionally or alternatively, a top drive system could be used.

In the example of FIG. 1, the surface system further includes drilling fluid 26, which is commonly referred to in the industry as mud, stored in a pit 27 formed at the well site. A pump 29 delivers the drilling fluid 26 to the interior of the drillstring 12 via a port (not shown) in the swivel 19, causing the drilling fluid 26 to flow downwardly through the drillstring 12 as indicated by directional arrow 8. The drilling fluid 26 exits the drillstring 12 via ports in the drill bit 105, and then circulates upwardly through the annulus region between the outside of the drillstring 12 and the wall of the wellbore, as indicated by directional arrows 9. The drilling fluid 26 lubricates the drill bit 105, carries formation cuttings up to the surface as it is returned to the pit 27 for recirculation, and creates a mudcake layer (not shown) on the walls of the wellbore 11.

The example BHA 100 of FIG. 1 includes, among other things, any number and/or type(s) of downhole tools, such as a logging-while-drilling (LWD) module 120 and/or a measuring-while-drilling (MWD) module 130, a rotary-steerable system or mud motor 150, and the example drill bit 105. Some of the example wireline logging tests described herein may be performed by the LWD module 120 and/or the MWD module 130. The example LWD module 120 is housed in a special type of drill collar and may contain any number of additional logging tools, fluid analysis devices, formation evaluation modules, stress tools, and/or fluid sampling devices. The example LWD module 120 may include capabilities for measuring, processing, and/or storing information, as well as for communicating with the MWD module 130 and/or directly with surface equipment, such as a logging and control computer 50. In the example of FIG. 1, the LWD module 120 is wirelessly communicatively coupled to the computer 50 via a transceiver 45.

The example MWD module 130 of FIG. 1 is also housed in a special type of drill collar and contains one or more devices for measuring characteristics of the drillstring 12 and/or the drill bit 105. The example MWD tool 130 further includes an apparatus (not shown) for generating electrical power for use by the downhole system 100. Example devices to generate electrical power include, but are not limited to, a mud turbine generator powered by the flow of the drilling fluid, and a battery system. Example measuring devices include, but are not limited to, a weight-on-bit measuring device, a torque measuring device, a vibration measuring device, a shock measuring device, a stick slip measuring device, a direction measuring device, and an inclination measuring device. The MWD module 130 also includes capabilities for communicating with surface equipment, such as the logging and control computer 50, using any past, present or future two-way telemetry system such as a mud-pulse telemetry system, a wired drill pipe telemetry system, an electromagnetic telemetry system and/or an acoustic telemetry system.

Figure 2:
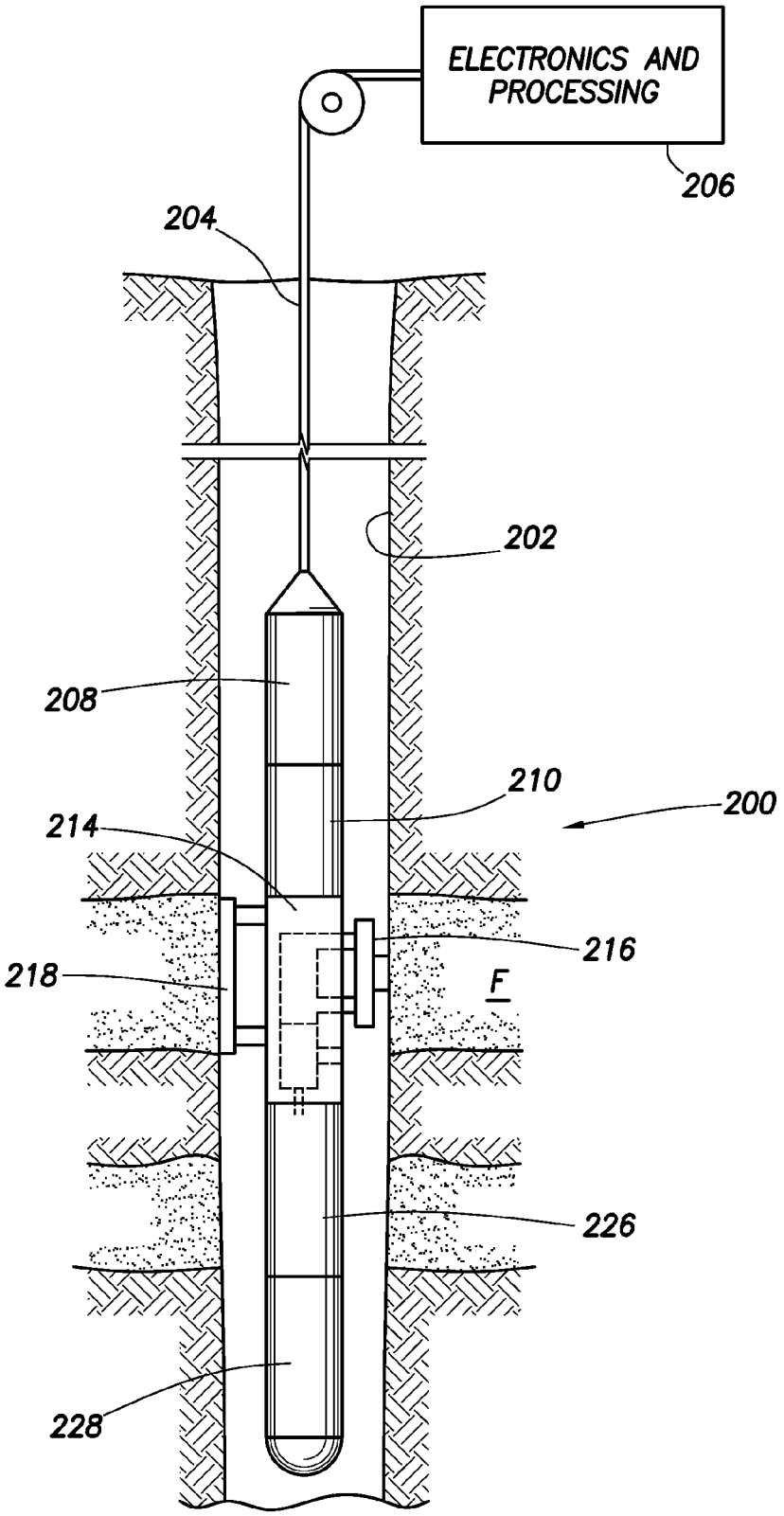
FIG. 2 depicts a partial cross-sectional view of an example wireline tool according to one or more aspects of the present disclosure.

FIG. 2 shows an example wireline tool 200 in another environment in which aspects of the present disclosure may be implemented. The example wireline tool 200 is suspended in a wellbore 202 (e.g., similar or identical to the wellbore 11 of FIG. 1) from the lower end of a multiconductor cable 204 that is spooled on a winch (not shown) at the Earth's surface. At the surface, the cable 204 is communicatively coupled to an electronics and processing system 206. The example wireline tool 200 includes an elongated body 208 that includes a formation tester 214 having a selectively extendable probe assembly 216 and a selectively extendable tool anchoring member 218 that are arranged on opposite sides of the elongated body 208. Additional components (e.g., a sonic tool 210) may also be included in the tool 200.

Figure 3A:
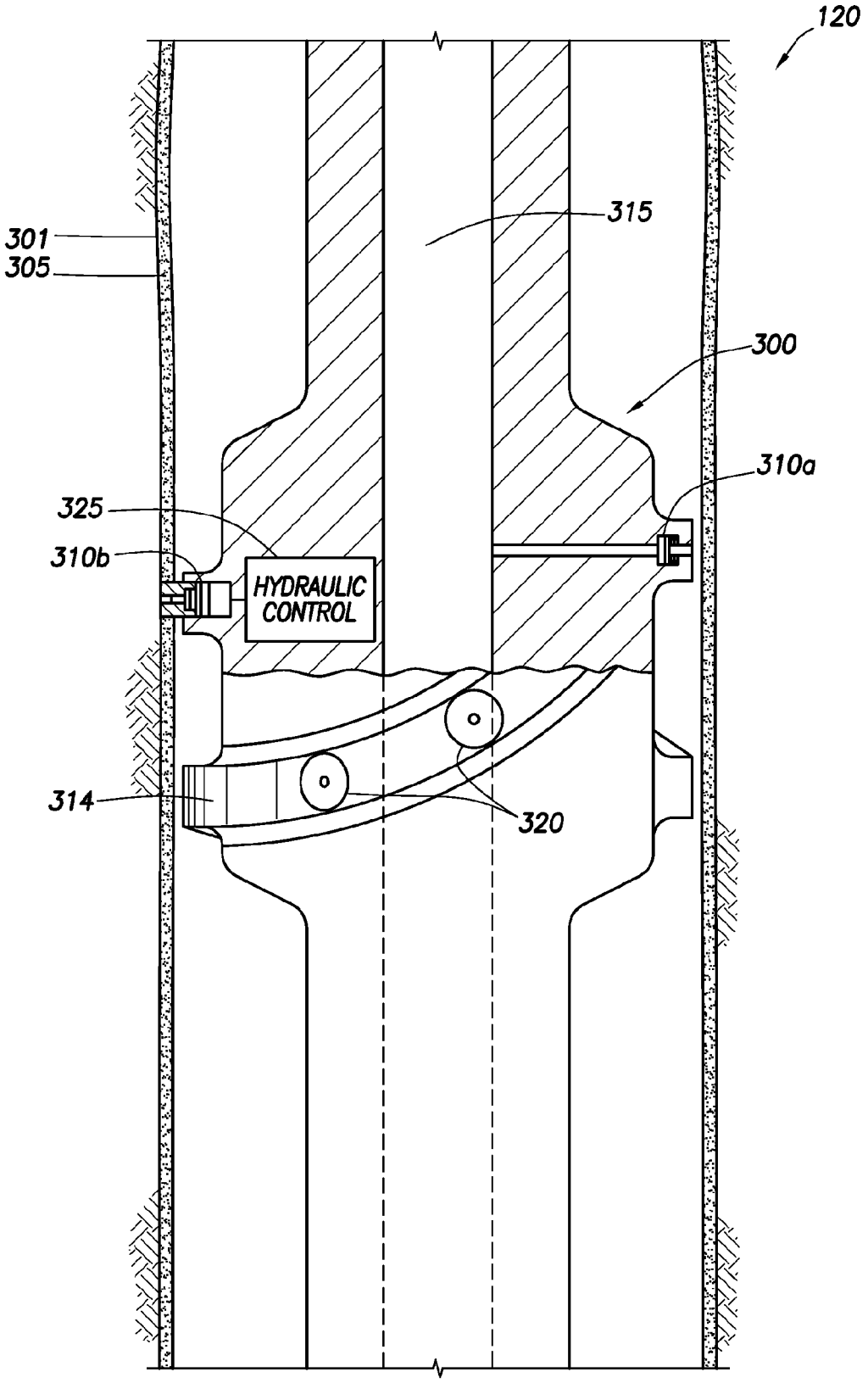
FIG. 3A depicts an example logging-while-drilling module according to one or more aspects of the present disclosure.
Figure 3B:
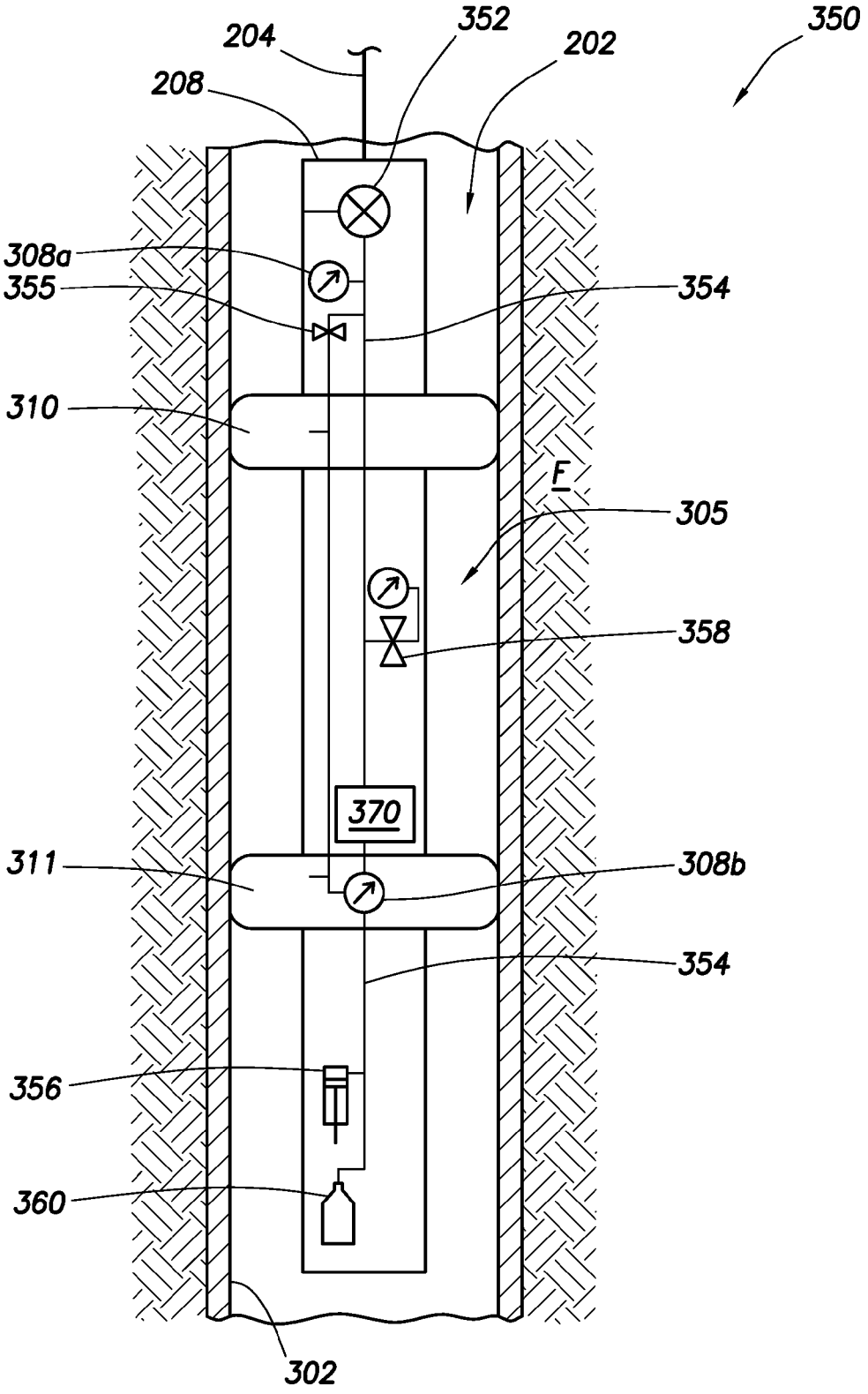
FIG. 3B depicts an example Modular Dynamic Tester tool according to one or more aspects of the present disclosure.

One or more aspects of the probe assembly 216 may be substantially similar to those described above in reference to the embodiments shown in FIGS. 3A and 3B. For example, the extendable probe assembly 216 is configured to selectively seal off or isolate selected portions of the wall of the wellbore 202 to fluidly couple to an adjacent formation F and/or to draw fluid samples from the formation F. Accordingly, the extendable probe assembly 216 may be provided with a probe having an embedded plate. The formation fluid may be expelled through a port (not shown) or it may be sent to one or more fluid collecting chambers 226 and 228. In the illustrated example, the electronics and processing system 206 and/or a downhole control system are configured to control the extendable probe assembly 216 and/or the drawing of a fluid sample from the formation F.

FIG. 3A illustrates another example manner of implementing the example LWD module 120 of FIG. 1. Because some elements of the example LWD module 120 of FIG. 3A are identical to those discussed above in connection with FIG. 1, the description of identical elements is not repeated here. Instead, identical elements are illustrated with identical reference numerals in FIGS. 1 and 3A, and the interested reader is referred back to the descriptions presented above in connection with FIG. 1 for a complete description of those like-numbered elements.

FIG. 3A is a simplified diagram of a logging device, of a type disclosed in U.S. Pat. No. 6,986,282, incorporated herein by reference, for determining downhole pressures including annular pressure, formation pressure, and pore pressure, during a drilling operation, it being understood that other types of pressure measuring LWD tools can also be utilized as the LWD tool 120 or part of an LWD tool suite 120. The device is formed in a modified stabilizer collar 300 which has a passage 315 extending through the LWD tool 120 for drilling fluid. The flow of fluid through the tool 120 creates an internal pressure $P_I$. The exterior of the drill collar is exposed to the annular pressure $P_A$ of the surrounding wellbore. The differential pressure $\delta P$ between the internal pressure $P_I$ and the annular pressure $P_A$ is used to activate pressure assemblies 310*a-b*. Two representative pressure measuring assemblies are shown at 310*a* and 310*b*, respectively mounted on stabilizer blades. Pressure assembly 310*a* is configured to monitor annular pressure in the wellbore and/or pressures of the surrounding formation when positioned in engagement with the wellbore wall. In FIG. 3A, the pressure assembly 310*a* is non-engaged with a wellbore wall 301 and, therefore, may measure annular pressure. When moved into engagement with the wellbore wall 301, the pressure assembly 310*a* may be used to measure pore pressure of the surrounding formation. As also seen in FIG. 3A, pressure assembly 310*b* is extendable from a stabilizer blade 314, using a hydraulic control 325, to seal an engagement with a mudcake 305 and/or the wall 301 of the wellbore for taking measurements of the surrounding formation. The stabilizer blade 314 includes pressure assemblies 320 to measure pressure within the stabilizer blade 314. The above referenced U.S. Pat. No. 6,986,282 can be referred to for further details. Circuitry (not shown in FIG. 3A) couples pressure-representative signals to a processor/controller, an output of which may be communicatively coupled to telemetry circuitry.

FIG. 3B depicts an example Modular Dynamic Tester (MDT) tool 350 according to one or more aspects of the present disclosure. As described in greater detail below, the example MDT tool 350 may be used to perform in-situ stress testing and/or to determine a closure stress of a shale formation. In the example of FIG. 3B, the MDT tool 350 may be part of a wireline tool (e.g., the wireline tool 200 of FIG. 2) that is suspended in the wellbore 202 within the Formation F from the lower end of the multiconductor cable 204. In other example implementations, the MDT tool 350 may be included within the LWD 120 of FIG. 1. A methodology for determining locations in the wellbore 202 at which to perform the stress testing using the MDT tool 350 is described in conjunction with FIGS. 7A and 7B.

The example MDT tool 350 is shown within the elongated body 208 of a wireline tool. To define a portion and/or pressure interval 305 of the wellbore 202, the example MDT tool 350 includes packers 310 and 311. The example packers 310 and 311 of FIG. 3B may have an annular shape and may be inflated to seal against a wall 302 of the wellbore 202. When the test interval boundaries and/or packers 310 and 311 are inflated, a portion of the wellbore 202 may be fluidly separated from other portions of the wellbore 202 by the packers 310 and 311 to create the pressure interval 305. In this manner, the example MDT tool 350 may apply a pressure to a portion of the wellbore wall 302 within the pressure interval 305. Before initiating a determination of the formation pressure, an example formation pressure identifier 370 may be used to inflate the packers 310 and 311.

The example packers 310 and 311 may have a rating that is a function of a diameter of the wellbore 202 and a fluid type of the wellbore. For example, in Barnett Shale applications, a maximum differential pressure applied to the packers 310 and 311 may vary from about 3,000 pounds per square inch (psi) for an 8.75 inch wellbore diameter to about 5,000 psi for an 8.5 inch wellbore diameter. Pressure gauges 308*a-b* measure the pressure within the packers 310 and 311. Additionally or alternatively, strain gauges may measure the pressure within the packers 310 and 311. Further, hydrostatic pressure may be subtracted from the pressure gauges 308*a-b* so that a differential packer pressure is monitored at a processor on the surface and/or by the formation pressure identifier 370.

The example MDT tool 350 of FIG. 3B also includes a pumpout module 352 that may contain a hydraulic pump to drive a double acting piston displacement unit that can pump fluids through an internal flowline 354 in either direction along the wellbore 202. The pumpout module 352 enables the MDT tool 350 to inflate the dual packers 310 and 311 using wellbore fluid. Once the packers 310 and 311 are inflated to a desired pressure, an inflate seal valve 355 may be closed so that the pumpout module 352 may be used to increase pressure within the pressure interval 305 without affecting the pressure in the packers 310 and 311. The pumpout module 310 enables the MDT tool 350 to inject the wellbore fluid into the isolated pressure interval 305 to initiate and/or propagate a fracture in the wellbore wall 302. A description of an example process to perform stress testing and/or initiate a fracture in the wellbore wall 302 is described in conjunction with FIGS. 8A and 8B. Further, the example pumpout module 352 enables an operator to pump wellbore fluid from the pressure interval 305 back into the wellbore 202 to perform hydraulic impedance tests. The example pumpout module 352 may also be used to deflate the packers 310 and 311 when stress testing at a given depth is completed.

To enable flowback of the wellbore fluid to be performed at a controlled rate, the example MDT tool 350 of FIG. 3B includes a flow control module 356. The example flow control module 356 prevents applied pressure in the pressure interval 305 from being immediately exposed to pressure in the wellbore 202, thereby preventing a rapid depressurization that could cause the packers 310 and 311 to become unseated from the wellbore wall 202. The flow control module 356 is fluidly coupled to the pumpout module 352 via the internal flowline 354.

The example MDT tool 350 also includes an interval seal valve 358 located between the pumpout module 352 and the pressure interval 305. The interval seal valve 358 is configured to prevent pressure loss through the pumpout module 352 after the module 352 is deactivated. The interval seal valve 358 may be fluidly coupled to the pumpout module 352 via the internal flowline 354. The interval seal valve 358 may be closed while the pumpout module 352 is pumping to cause the module 352 to stall once the valve 358 is closed. Further, the interval seal valve 358 may be used to perform impulse tests (e.g., hydraulic impulse testing) where the pumpout module 352 is engaged until the valve 358 is closed, thereby causing the module 352 to stall. The interval seal valve 358 may then be opened to cause pressure behind the valve 358 to be applied to the pressure interval 305. During impulse testing, the valve 358 may be opened and closed multiple times until a fracture in the wellbore wall 302 is identified.

To collect fluid samples from in-situ stress tests, the example MDT tool 350 of FIG. 3B includes a sample chamber 360. For example, samples from bounding permeable carbonates may be collected in the sample chamber 360 during stress testing at the pressure interval 305. Dissolved solids within the collected samples may then be compared to produced water samples to determine if bounding formation waters are being produced during the stress tests. In other instances, the sample chamber 360 may store fluids used to clean the MDT tool 350 if plugging from drill cuttings interferes with stress tests.

Additionally or alternatively, the sample chamber 360 may be used to carry a fracturing fluid to perform in-situ fracturing fluid compatibility testing. For example, if the wellbore wall 302 is comprised of swelling clays and/or clays are present in the formation F and water-based drilling mud is in the wellbore 202, the sample chamber 360 may store oil-based fluid. The oil-based fluid can be used first to create fractures and observe pressure declines in the wellbore wall 302 within the pressure interval 305. Drilling mud may then be circulated across the pressure interval 305 to initiate fractures again using the water-based drilling mud. A relatively different pressure decline rate following the water-based fluid injection may indicate clay swelling and/or water imbibition.

The example MDT tool 350 of FIG. 3B may inject fluid into the pressure interval 305 at rates varying from about 0.10 gallons per minute (gal/min) to 0.35 gal/min depending on the injection pressure. In stress-testing of shale, the relatively low injection rates generally do not result in leakoff of the pressure applied to the pressure interval 305. Further, such relatively low injection rates also reduce the likelihood of fractures in the wellbore wall 302 growing past the packers 310 and 311. Maintaining fractures to within the pressure interval 305 results in a pressure decline that facilitates a determination of closure pressure. Still further, the relatively low injection rates may be used to yield adequate fracture geometries for low permeability shale reservoirs (e.g., formations).

Figure 4:
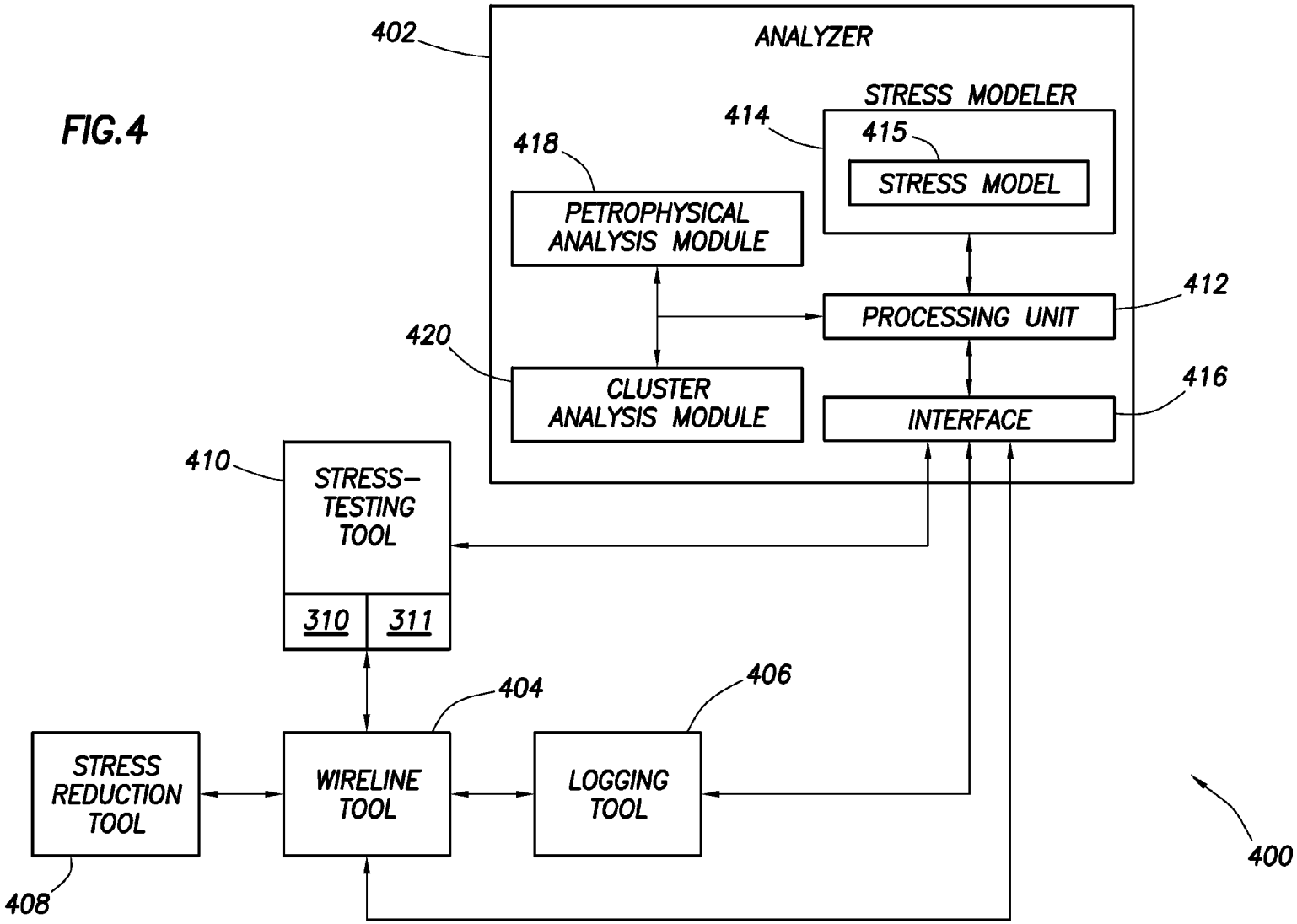
FIG. 4 depicts a system to measure formation stresses according to one or more aspects of the present disclosure.

FIG. 4 depicts a system 400 to measure formation stresses according to one or more aspects of the present disclosure. The example system 400 includes an analyzer 402, and a wireline tool 404, which may include a logging tool 406, a stress reduction tool 408, and a stress-testing tool 410.

The analyzer 402 includes a processing unit 412, a stress modeler 414, an interface 416, a petrophysical analysis module 418, and a cluster analysis module 420. Any one or more portions of the analyzer 402 may be implemented using the processor platform P100 as described with reference to FIG. 5 below.

In general, the wireline tool 404 is used as a conveyance for the logging tool 406, the stress reduction tool 408, and/or the stress-testing tool 410. The wireline tool 404 may be implemented using the example wireline tool 200 described in connection with FIG. 2. However, the wireline tool 404 may be replaced with a LWD conveyance, such as the LWD module 120 described in connection with FIG. 1.

In general, the logging tool 406 is lowered into a wellbore (e.g., a wellbore adjacent a subterranean shale formation), and generates logging results associated with the wellbore. The logging results may include, for example, petrophysical information, scanning and/or image data. The logging tool 406 may include any one or more of Schlumberger's Platform Express Integrated Wireline Logging, including an elemental capture spectroscopy sonde, and/or an acoustic scanning platform such as Schlumberger's Sonic Scanner, which may include any of a full-bore formation micro-imager, a formation micro-scanner, an oil-base micro-imager, and/or an ultrasonic imager. However, other scanners, imagers, and/or data collecting tools may additionally or alternatively be used. Data and/or images obtained by the logging tool 406 are provided to the analyzer 402 to be processed to determine appropriate test intervals for stress-testing, and/or to determine a test sequence in which to test the determined test intervals.

The stress modeler 414 includes a stress model 415 that is used by the analyzer 402 and receives input data associated with formation evaluation, such as geologic data, seismic data, image data, scanner data, petrophysical data, and/or any other type of data associated with formation evaluation. The example stress model 415 may be implemented using, for example, computer-readable instructions stored in a machine-readable memory and executed by a processor. An example processing platform P100 is described below in conjunction with FIG. 5. Upon receiving data from the logging tool (e.g., via the processing unit 412 and the interface 416), the stress modeler 414 determines breakdown pressures and/or closure stresses in a particular formation or wellbore. The closure stresses may be used to adjust or calibrate a stress profile of, for example, a shale formation by modifying the appropriate strain coefficients. The breakdown pressures and/or closure stresses may later be used to calculate (e.g., via the processing unit 412) fracturing height growth using a fracturing height growth simulator (not shown). The breakdown pressures and/or closure stresses are useful to determine appropriate strategies for increasing hydrocarbon production from a formation such as shale.

The interface 416 is configured to communicate with the wireline tool 404, the logging tool 406, and/or the stress-testing tool 410. The wireline tool 404, the logging tool 406, and/or the stress-testing tool 410 may have substantially different data and/or command communication structures. For example, the logging tool 406 may include command and data structures related to scanning and imaging tools, while the stress-testing tool 410 includes command and data structures used in pressure testing. The interface 416 therefore enables the processing unit 412, the stress modeler 414, the petrophysical analysis module 418, and/or the cluster analysis module 420 to process different types of data and/or commands.

The petrophysical analysis module 418 receives input data and determines the petrophysical properties of a formation. The input data may be, for example, logging results data received from the logging tool 406. The petrophysical properties of the formation at least partially determine how the test intervals are identified, and may include lithology of the rock in the formation, porosity, water saturation, permeability, thickness, and/or any other properties that may affect the behavior and/or composition of the rock formation being evaluated. The petrophysical analysis module 418 may then output the petrophysical properties of different portions of the wellbore.

The cluster analysis module 420 receives information relating to the selected or identified portions of the wellbore as well as the corresponding petrophysical properties from the petrophysical analysis module 418. The cluster analysis module 420 identifies relatively smaller adjacent portions of the wellbore having substantially similar petrophysical properties and clusters the smaller portions into relatively larger portions. When adjacent portions of the wellbore have sufficiently different properties, the cluster analysis module 420 marks the portions as different test intervals. The portions as assembled (or deconstructed) by the cluster analysis module 420 need not be the same size or length. After the cluster analysis module 420 has further identified and/or refined the selection of test intervals of the wellbore from the petrophysical properties, the cluster analysis module 420 may return instructions identifying these test intervals to the stress modeler 414 and/or to the petrophysical analysis module 418. The stress modeler 414 and/or the petrophysical analysis module 418 may then determine how the petrophysical properties of each of these test interval affects the anticipated breakdown pressure and/or closure stresses of these test intervals.

The stress reduction tool 408 is used when the logging tool 406 and/or the analyzer 402 determine that one or more of the test intervals may require a relatively high pressure to induce a fracture such that the stress-testing tool 410 may not be able to induce a fracture at that test interval. For this purpose, the example stress reduction tool 408 may include any one or more of a mechanical sidewall coring tool, a cased hole dynamics tester (CHDT), and/or a perforating gun to create a weak point in the wall of the wellbore within the determined test interval.

For example, if the analyzer 402 determines that a test interval will require a high pressure to fracture, the stress reduction tool 408 may be lowered (or raised) via the wireline tool 404 to the location of the test interval. If a mechanical sidewall coring tool is used, the stress reduction tool 408 removes a core from the wall of the wellbore, which may later be used for analysis at the surface. Core plugs reduce the stress concentration at the formation face and can reduce the fracture initiation pressure. The core plugs are most effective when the plugs are oriented in or near the azimuth of the maximum horizontal stress. In examples where the stress reduction tool 408 includes a CDHT, the stress reduction tool 408 removes core plugs from cased holes as opposed to open holes. Alternatively, a perforating gun may be used to set off explosive charges downhole at designated locations to weaken the wellbore wall at the test interval.

After identifying and ordering the test intervals and weakening one or more of the test intervals (if needed), the stress-testing tool 410 (e.g., the MDT tool 350 of FIG. 3B) is deployed into the wellbore via the wireline tool 404. The stress-testing tool 410 is lowered and/or raised to each of the determined test intervals to perform in-situ stress tests, starting with the test intervals having lower anticipated breakdown pressures.

When the stress-testing tool 410 reaches a test interval, multiple pressure injections and/or pressure declines may be performed. The example stress-testing tool 410 includes packers 310 and 311. One of the packers (e.g., the packer 310 of FIG. 3B) is located uphole of a pressure interval (e.g., the pressure interval 305 of FIG. 3B), into which fluid is injected to create pressure on the formation. The other packer (e.g., the packer 311) is located downhole of the pressure interval 305. Once the stress-testing tool 410 is in place, the packers 310 and 311 are inflated to create a hydraulic seal between the pressure interval 305 and the remainder of the wellbore.

When the packers 310 and 311 (FIG. 3B) have created a hydraulic seal, the stress-testing tool 410 applies pressure by pumping fluid into the pressure interval 305 between the packers 310 and 311. As the fluid pressure in the pressure interval 305 increases, the pressure on the wellbore wall also increases. The stress-testing tool 410 monitors the differential pressure (i.e., the difference in pressure between the inside of a packer 310 and 311 and the outside of the packer 310 and 311) of the packers 310 and 311 to ensure that the packers 310 and 311 are not subjected to an excessive differential pressure. If the packers 310 and 311 are subjected to excessive differential pressures, the likelihood of the packers 310 and 311 rupturing increases. At a pressure (called the breakdown pressure) determined by the petrophysical properties and features of the wellbore wall in the test interval, the wellbore wall develops a fracture. The breakdown pressure required to fracture the formation is the pressure which overcomes the pressure of the formation as well as the tensile pressure along the wellbore wall. When the fracture occurs, the pressure on the formation (i.e., in the pressure interval 305) will decrease to a propagation pressure as the fluid escapes into the fracture.

After the fracture occurs, the stress-testing tool 410 decreases the pressure by allowing fluid to exit the pressure interval 305 (FIG. 3B) into the wellbore. When the pressure decreases, the fracture eventually closes at a closure pressure. Additional applications of pressure to the test interval will cause the fracture to reopen at a reopening pressure that is generally less than the breakdown pressure.

Occasionally, a fracture may not occur before the packer differential pressure has reached an upper limit (e.g., a limit safe for the packers 310 and 311). In such a case, the stress-testing tool 410 may be relocated such that the pressure interval 305 is located where one of the packers 310 or 311 was previously inflated against the wellbore wall. The pressure applied by the packers 310 and 311 against the wellbore wall may be greater than the pressure applied in the pressure interval 305, and may create a weak point in the wellbore wall where a measurable pressure in the pressure interval 305 may subsequently cause a fracture. An example process to perform an in-situ stress test at a test interval is described in more detail with reference to FIGS. 8A and 8B below.

After the in-situ stress-testing is completed on each of the test intervals in a test sequence, the example logging tool 406 is used again to re-analyze the wellbore. In particular, the logging tool 406 may be used to evaluate (e.g., via scanning and/or imaging) the fractures created during the in-situ stress-testing. The additional data may be helpful to, for example, develop a more accurate stress model 415 and/or develop a more accurate hydraulic fracture height growth simulator.

During or after performing stress-testing on each of the test intervals, the data derived from the stress-testing is provided to the analyzer 402 (e.g., the processing unit 412). The data is then used to calibrate the stress modeler 414. For example, the estimated breakdown pressures and/or closure stresses may be compared to estimates provided by the stress modeler 414 prior to the stress-testing. The stress model 415 may then be calibrated to improve the accuracy of the stress model 415 with respect to the particular formation. After calibrating the stress modeler 414, the stress modeler 414 may be used to determine improved parameters for producing hydrocarbons from the wellbore. Such parameters may include, for example, a lateral landing point, a hydraulic fracture fluid volume, a hydraulic fracture fluid viscosity, a hydraulic fracture proppant type, hydraulic fracture proppant addition schedules, and/or a hydraulic fracturing pump rate.

Figure 5:
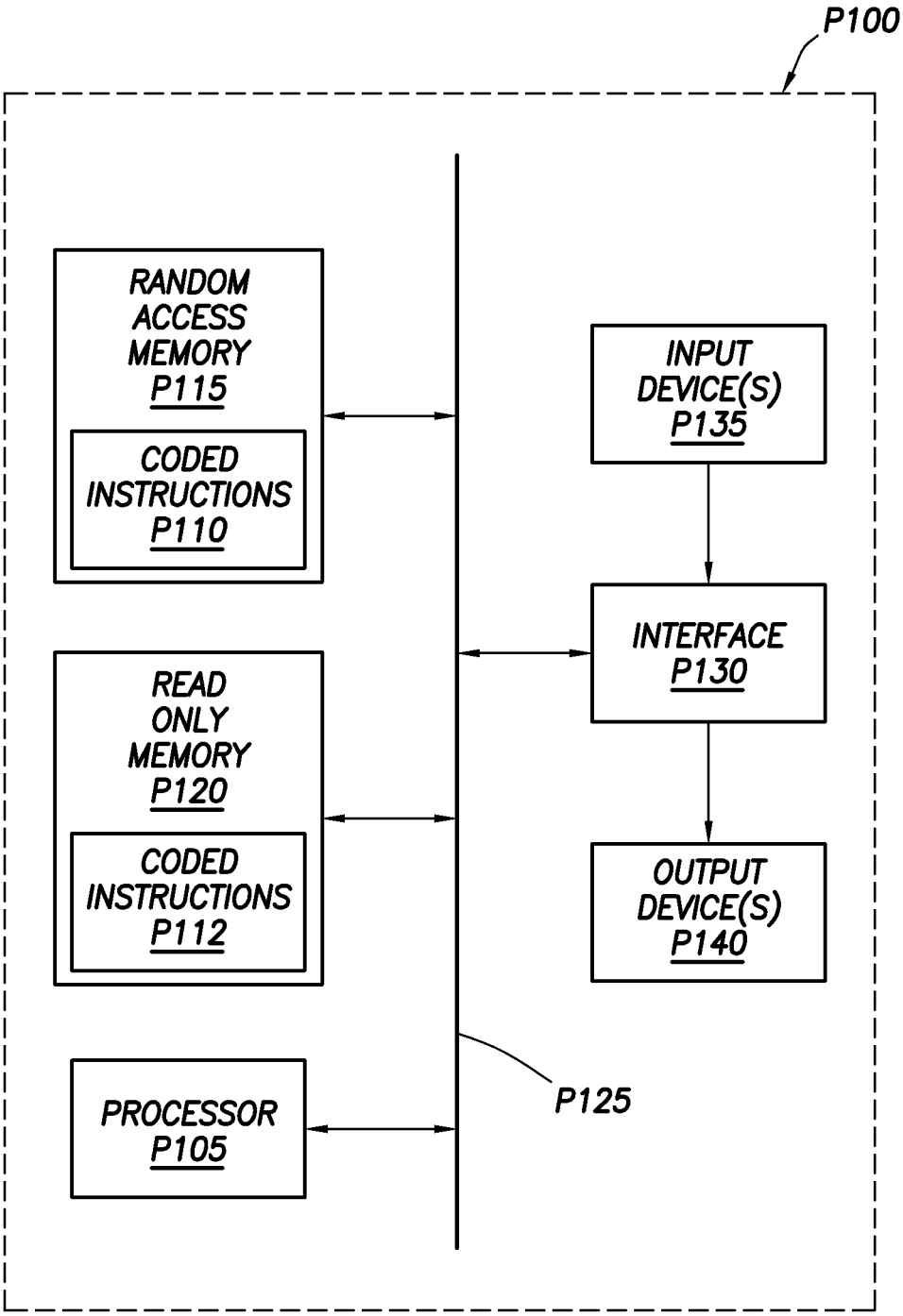
FIG. 5 depicts an example processor platform that may be used and/or programmed to implement one or more aspects of the present disclosure.

FIG. 5 is a schematic diagram of an example processor platform P100 that may be used and/or programmed to implement the example processes 600, 700, and/or 800 of FIGS. 6A, 6B, 7A, 7B, 8A, and 8B, and/or the example LWD 120, the example MWD 130, the example wireline tools 200 and 404, the example sonic tool 210, the example formation tester 214, the example MDT tool 350, the example analyzer 402, the example logging tool 406, the example stress reduction tool 408, the example stress-testing tool 410, the example processing unit 412, the example stress modeler 414, the example interface 416, the example petrophysical analysis module 418, the example cluster module 420 and/or, more generally, the example system 400 of FIGS. 1, 2, 3A, 3B, and 4. For example, the processor platform P100 can be implemented by one or more general-purpose processors, processor cores, microcontrollers, etc.

The processor platform P100 of the example of FIG. 5 includes at least one general-purpose programmable processor P105. The processor P105 executes coded instructions P110 and/or P112 present in main memory of the processor P105 (e.g., within a RAM P115 and/or a ROM P120). The processor P105 may be any type of processing unit, such as a processor core, a processor and/or a microcontroller. The processor P105 may carry out, among other things, the example processes of FIGS. 6A, 6B, 7A, 7B, 8A, and 8B to measure formation pressures.

The processor P105 is in communication with the main memory (including a ROM P120 and/or the RAM P115) via a bus P125. The RAM P115 may be implemented by dynamic random-access memory (DRAM), synchronous dynamic random-access memory (SDRAM), and/or any other type of RAM device, and ROM may be implemented by flash memory and/or any other desired type of memory device. Access to the memory P115 and the memory P120 may be controlled by a memory controller (not shown).

The processor platform P100 also includes an interface circuit P130. The interface circuit P130 may be implemented by any type of interface standard, such as an external memory interface, serial port, general-purpose input/output, etc. One or more input devices P135 and one or more output devices P140 are connected to the interface circuit P130. The example output device P140 may be used to, for example, control the example MDT tool 350 of FIG. 3B. The example input device P135 may be used to, for example, obtain pressure readings from the example pressure gauges 308*a* and 308*b* of FIG. 3B.

While example manners of implementing the example system 400 of FIG. 4 have been illustrated in FIGS. 1, 2, 3A, 3B, and 4, one or more of the elements, sensors, circuits, modules, processes and/or devices illustrated in FIGS. 1, 2, 3A, 3B, and 4 may be combined, divided, re-arranged, omitted, eliminated and/or implemented in any other way. For example, while the illustrated example of FIG. 4 depicts the example logging tool 406, the example stress reduction tool 408, the example stress-testing tool 410 as implemented or deployed by a wireline module 404, one or more of the example logging tool 406, the example stress reduction tool 408, the example stress-testing tool 410 depicted as being implemented or deployed by the example wireline module 404 may be implemented by one or more other modules of the drillstring 12 of FIG. 1.

Further, the example LWD 120, the example MWD 130, the example wireline tools 200 and 404, the example sonic tool 210, the example formation tester 214, the example MDT tool 350, the example analyzer 402, the example logging tool 406, the example stress reduction tool 408, the example stress-testing tool 410, the example processing unit 412, the example stress modeler 414, the example interface 416, the example petrophysical analysis module 418, the example cluster module 420 and/or, more generally, the example system 400 of FIGS. 1, 2, 3A, 3B, and 4 may be implemented by hardware, software, firmware and/or any combination of hardware, software and/or firmware. Thus, for example, any or all of the example LWD 120, the example MWD 130, the example wireline tools 200 and 404, the example sonic tool 210, the example formation tester 214, the example MDT tool 350, the example analyzer 402, the example logging tool 406, the example stress reduction tool 408, the example stress-testing tool 410, the example processing unit 412, the example stress modeler 414, the example interface 416, the example petrophysical analysis module 418, the example cluster module 420 and/or, more generally, the example system 400 of FIGS. 1, 2, 3A, 3B, and 4 may be implemented by one or more circuit(s), programmable processor(s), application specific integrated circuit(s) (ASIC(s)), programmable logic device(s) (PLD(s)), field-programmable logic device(s) (FPLD(s)), field-programmable gate array(s) (FPGA(s)), etc. The LWD module 120 and/or the wireline module 404 may include elements, sensors, circuits, modules, processes and/or devices instead of, or in addition to, those illustrated in FIGS. 1, 2, 3A, 3B, and 4, and/or may include more than one of any or all of the illustrated elements, sensors, circuits, modules, processes and/or devices.

Figure 6A:
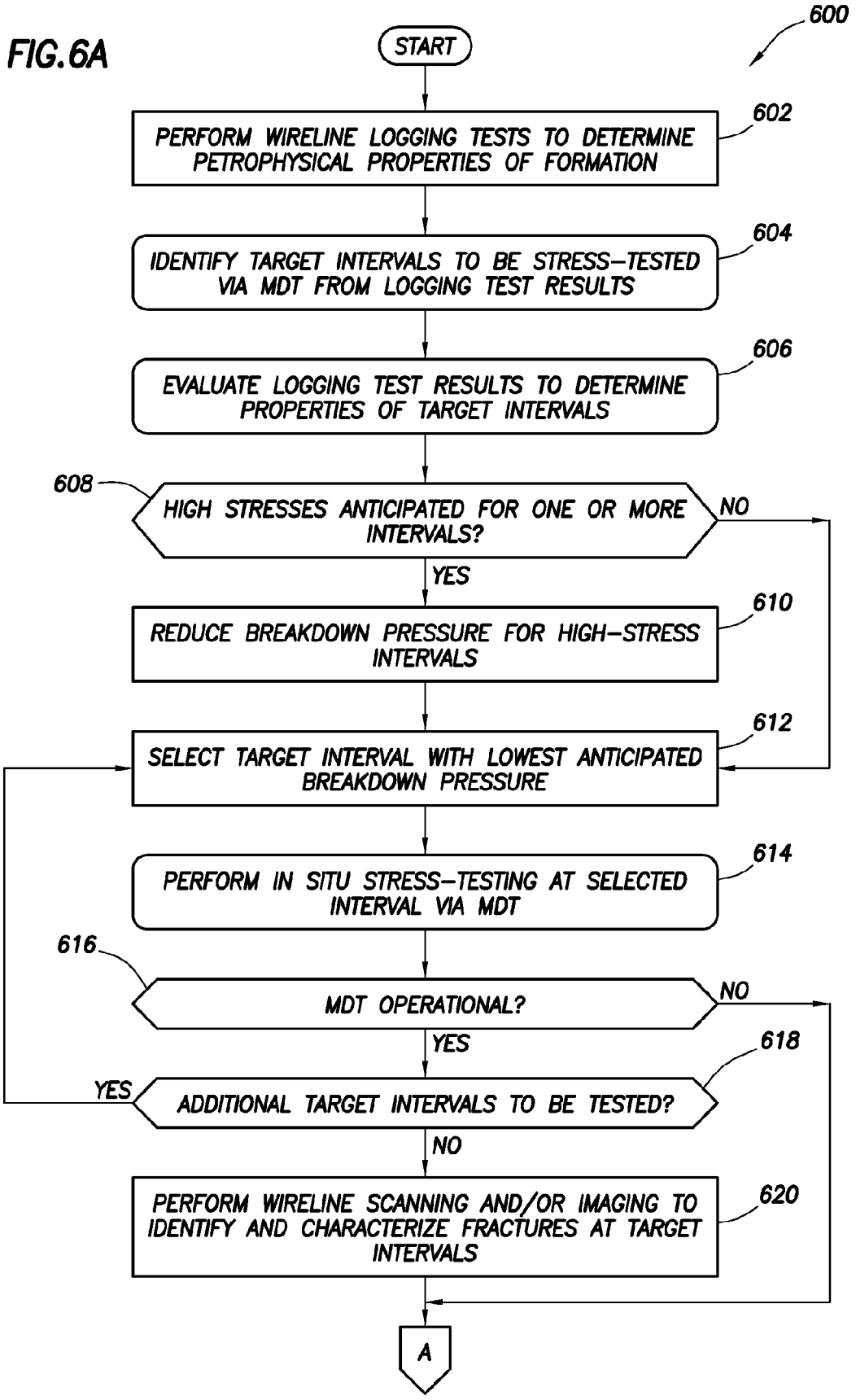
FIGS. 6A and 6B depict an example process to perform stress testing according to one or more aspects of the present disclosure.
Figure 6B:
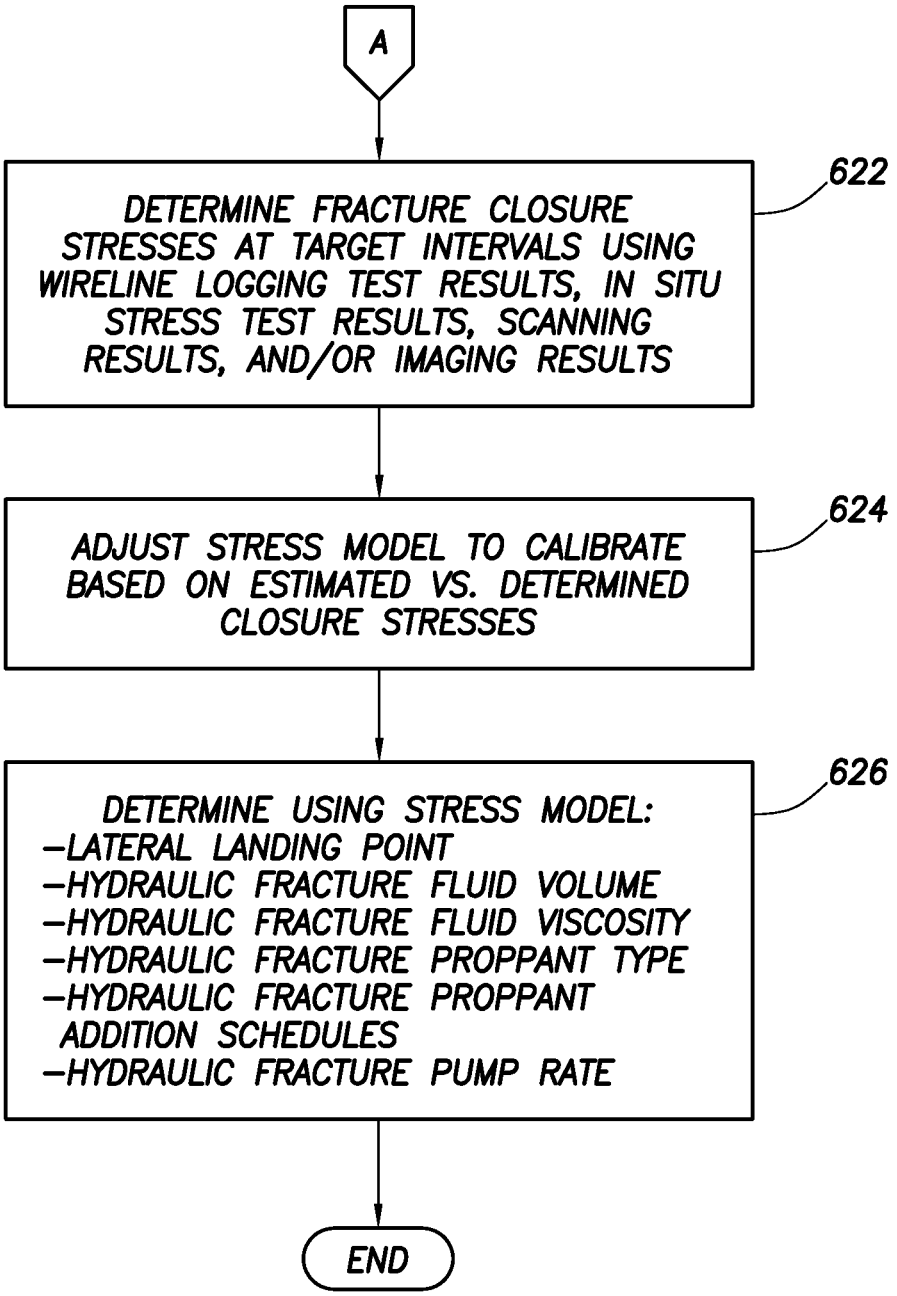

FIGS. 6A and 6B depict an example process 600 to perform stress-testing according to one or more aspects of the present disclosure. The example process 600 increases the number of data points that may be collected compared to previous methods (e.g., using a wireline formation tester tool), and decreases differential pressures placed on the packers 310 and 311, which may improve longevity of the MDT tool 350 while in the wellbore.

The example process 600 of FIGS. 6A and 6B begins by performing wireline logging tests to determine petrophysical properties of a formation (e.g., a shale formation) (block 602). The example logging tests may include using Schlumberger's Platform Express Integrated Wireline Logging, which includes an elemental capture spectroscopy sonde, and/or using an acoustic scanning platform such as Schlumberger's Sonic Scanner, which includes a full-bore formation microimager, a formation microscanner, an oil-base microimager, and/or an ultrasonic imager.

Using the measured petrophysical properties, the example process 600 identifies target test intervals to be in-situ stress-tested (e.g., via the MDT tool 350 described in connection with FIG. 3B) (block 604). The process 600 may perform petrophysical and cluster analyses on the logs developed in block 602. Performing petrophysical and cluster analyses may identify appropriate test intervals to stress-test via the MDT tool 350. Data derived from the stress-tests, as described in more detail below, provide the appropriate stresses to calibrate a stress model and to quantify hydraulic fracture height growth that may be expected during stimulation treatments associated with well completion.

The example process 600 then evaluates the logs to determine properties of the target test intervals (block 606). Example properties that may be determined from the logs include petrophysical and/or mechanical properties. From the determined properties, a testing methodology may be developed to first test intervals that are anticipated to have lower stresses (e.g., closure stress and/or breakdown pressure), and/or higher horizontal stress anisotropy, taking into account hole conditions that may increase the likelihood of successful test interval isolation. Testing the lower-stress test intervals first may place less differential pressure on the packers for a longer time period, which may increase the longevity of the packers. Additionally, in shale hydrocarbon formations, more valuable hydrocarbon-producing locations tend to have lower stress due to less clay and/or higher silica and/or carbonate content contained in such locations. Therefore, if the MDT tool 350 and/or the packers 310 and 311 are disabled during stress-testing of higher-stress test intervals after completing stress-testing of lower-stress test intervals, the more valuable stress-testing has already been completed at the time the MDT tool 350 is disabled. In contrast, if the lower-stress test intervals are stress-tested last, additional testing would probably be necessary at a relatively high cost.

The example process 600 then determines whether high stresses are anticipated for any one or more of the selected test intervals (block 608). High stresses refer to differential stress levels placed on the packers 310 and 311 (FIG. 3B) in the MDT tool 350 while attempting to fracture a test interval during a stress test. Differential stress levels refer to the difference in pressure between the inside of a packer (e.g., the packers 310 and 311) and the outside of the packer. Differential stresses tend to be higher between the inside of the packer 310 or 311 and the hydrostatic pressure within the wellbore than between the inside of the packer 310 or 311 and the pressure in the pressure interval 305 between the packers 310 and 311. If high stresses are anticipated (block 608), the example process 600 reduces the breakdown pressure for the anticipated high-stress test intervals (block 610). For example, the process 600 may acquire one or more sidewall coring plugs from the test intervals (e.g., and/or may use a perforating gun (such as Schlumberger's Capsule Gun perforating systems and/or Hollow Carrier Gun perforating systems) to create flaws in the formation and reduce hydraulic fracture initiation pressure.

After reducing the breakdown pressures (block 610), or if high stresses are not anticipated (block 608), the example process 600 selects a target test interval having the lowest anticipated breakdown pressure (block 612). The MDT tool 350 then performs in-situ stress-testing at the selected test interval (block 614). A more detailed description of the process of block 614 is provided below in conjunction with FIGS. 8A and 8B. The example process 600 may run a wipe process prior to performing stress-testing of the test interval locations. The wipe process reduces cuttings in the wellbore and provides a drill operator an opportunity to prepare an appropriate mud mix for stress-testing. The MDT tool 350 may tolerate viscous fluids, but higher injection rates and/or more rapid pressure declines may be achieved when thinner or less viscous fluids are used. However, lost circulation material may not be tolerated by the MDT tool 350.

After performing the in-situ stress-testing (block 614), the example process 600 determines if the MDT tool 350 is still operational (e.g., the packers 310 and 311 have not failed from the differential pressures) (block 616). If the MDT tool 350 has not failed (block 616), the example process 600 determines whether any additional test intervals are to be tested (block 618). If there are additional test intervals to be tested (block 618), control returns to block 612 to select a target test interval in a test sequence having the next-lowest anticipated breakdown pressure. However, if there are no additional test intervals to be tested (block 618), the example process 600 performs a wireline scanning and/or imaging run to identify and/or characterize fractures at the target test intervals (block 620). The example scanning and/or imaging run may be performed using an acoustic scanning platform (e.g., Schlumberger's Sonic Scanner), which may include any one or more of a full-bore formation microimager (e.g., Schlumberger's Full-Bore Formation MicroImager), a formation microscanner (e.g., Schlumberger's Formation MicroScanner), an oil-base microimager (e.g., Schlumberger's Oil-Base MicroImager), and/or an ultrasonic imager (e.g., Schlumberger's UltraSonic Imager) to identify and/or characterize the presence, location, nature, and/or orientation of the fractures created during the in-situ stress-testing sequence(s).

The example process 600 of FIG. 6B continues by determining or estimating fracture closure stresses at the target test intervals using the wireline logging test results, the in-situ stress-testing results, the scanning results, and/or the imaging results (block 622). The determined fracture closure stresses are compared to predicted fracture closure stresses generated by a stress model to calibrate the stress model to the measured data (block 624). For example, the stress model may incorporate anisotropic mechanical properties to generate estimated fracture closure stresses, which may be used to generate new stress model estimates prior to comparing the determined fracture closure stresses.

After adjusting or calibrating the stress model, the example process 600 models hydraulic fracture height growth using a fracturing simulator based on the calibrated stress model (block 626). Fracture height growth estimates determine production strategies. The fracturing simulator and/or the calibrated stress model may be used to determine, for example, a lateral landing point, a hydraulic fracture fluid volume, a hydraulic fracture fluid viscosity, a hydraulic fracture proppant type, hydraulic fracture proppant addition schedules, and/or a hydraulic fracturing pump rate. The example process 600 ends after modeling the hydraulic fracture height growth.

Figure 7B:
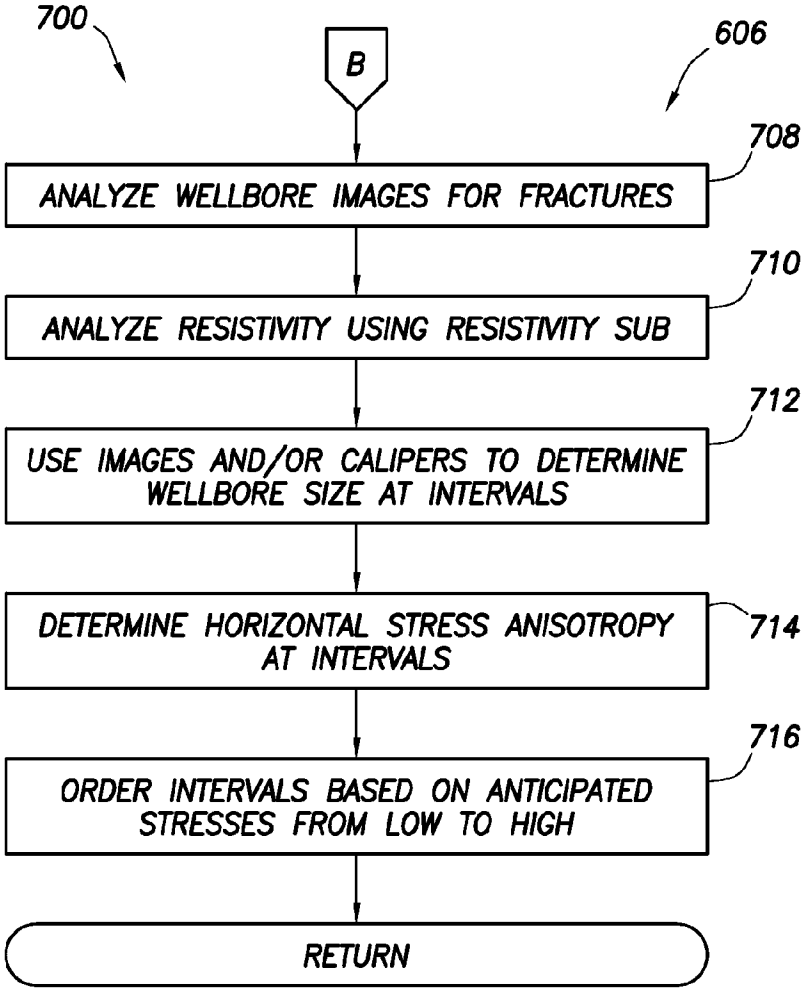
FIGS. 7A and 7B depict an example process to select test intervals in which to perform stress testing according to one or more aspects of the present disclosure.
Figure 7A:
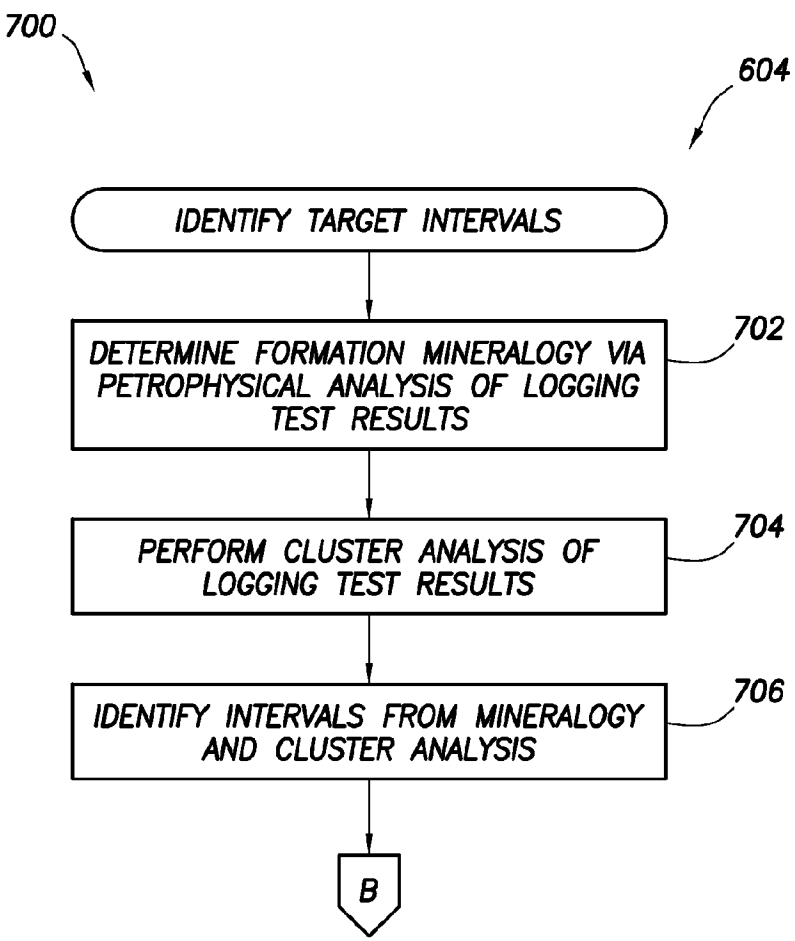

FIGS. 7A and 7B depict an example process 700 to select test intervals and determine an order in which to perform stress-testing according to one or more aspects of the present disclosure. The example process 700 may be used to implement blocks 604 and 606 of the example process 600 of FIG. 6A. The example process 700 may be used to increase the number of data sets collected to calibrate a stress model. To select the target test intervals, the example process 700 of FIG. 7A determines the mineralogy of the formation by performing a petrophysical analysis using logging test results (e.g., as determined from block 602 of FIG. 6A) (block 702). For example, shale formations having low clay content and high silica and/or carbonate content typically have lower fracture closure stresses. Additionally, shale formations normally contain higher quantities of hydrocarbon. Thus, the MDT tool 350 may focus on these test intervals at the beginning of the testing sequence, as testing such test intervals imparts less force on the packers and the results are of higher importance. A target test interval preferably includes a continuous portion of the formation having a substantially similar closure stress along the test interval. Therefore, different test intervals may have different closures stresses or may have similar closure stresses and are separated by a test interval having a different closure stress.

The example process 700 then uses a cluster analysis of the logging test results to determine appropriate test intervals for testing (block 704). One advantage of using cluster analysis is that it may identify test intervals in a wellbore in which the petrophysical properties have changed relative to offset wellbores (i.e., other wellbores close to the wellbore being tested). Once identified, these test intervals may be selected for in-situ stress-testing. The test sequence in which they are tested is based on anticipated breakdown pressures of the test intervals as described in more detail below. Based on the cluster analysis and mineralogy, the example process 700 then identifies preferable test intervals (block 706). Control is then passed from block 604 to block 606, an example implementation of which is illustrated in FIG. 7B.

Turning to FIG. 7B, the example process 700 analyzes the target test intervals identified in FIG. 7A to determine a test sequence to stress-test the test intervals. To determine the test sequence, the example process 700 first analyzes wellbore images for fractures (block 708). Wellbore images may be acquired with, for example, a full-bore formation microimager, a formation microscanner, a resistivity sub, an oil-base microimager, and/or an ultrasonic wellbore imager. The wellbore images provide information about the stresses experienced by the formation at the test intervals, which can contribute to a determination of an appropriate stress-testing sequence. For example, in test intervals having relatively low stress, wells that are drilled with liquids (in contrast to air-drilled wells) may contain small fractures at the wellbore wall that can be seen with image tools. If induced fracture variation exists through the test intervals, then it may be inferred that stress variations also exist.

The wellbore image log may be used to identify and select test depths containing healed natural fractures. Healed natural fractures may be considered flaws in a formation and have proven to be weak points from which hydraulic fractures may be created. Thus, for test intervals where the pressure limitations of the MDT tool 350 (e.g., packer differential pressure limitations) are reached before hydraulic fractures are created, the MDT tool 350 may be deployed to isolate natural fractures in the target test intervals to increase the likelihood that a successful stress-test will be achieved.

Dipole sonic logs may also be used to differentiate between open natural fractures and drilling induced (i.e., hydraulic) fractures. Additionally, an acoustic scanning platform may quantify the azimuth of fractures. Likewise, the acoustic scanning platform may identify the presence and/or orientation of the fractures. Images may also be used to identify and locate healed natural fractures. If it is determined that natural fractures are oblique to drilling induced fractures, tests may be performed in these test intervals to determine a likelihood that the natural fractures will be stimulated during the well completion process. However, the presence of fractures does not guarantee that the fractures will accept fluid during the stimulation treatment. By testing intervals containing fractures and using images to evaluate the nature of the fractures following fluid injection, the example process 700 may determine whether such a complex network of fractures will be created during completion and/or stimulation. The behavior of natural and/or drilling induced fractures may be important in ultra-low permeability reservoirs (e.g., shale formations) because a dense network of closely spaced, complex fractures has proven beneficial for increasing hydrocarbon recovery.

The example process 700 continues by using a resistivity substructure to determine the resistivity of the test intervals (block 710). In shale formations, the closure stress is inversely proportional to the resistivity of the rock because resistivity is a function of clay volume, which is in turn a function of closure stress. Where more clay is present, the shale formation has a lower resistivity and a higher closure stress. Therefore, a static resistivity track image may be used to infer stress and, thus, select stress-testing test intervals and test sequences.

The example process 700 further evaluates the wellbore images to identify information pertaining to wellbore size and/or shape at the test intervals (block 712). To isolate test intervals with packers 310 and 311, the packers 310 and 311 are inflated in sections where the hole is in gauge (e.g., the size of the drill bit). Calipers from the image logs, in addition to the images themselves, allow quantifying of hole conditions and confirming accurate depth selection points. Calipers may be run in combination with the petrophysical logs to confirm the hole conditions. Thus, the wellbore images may provide information to select the test depth of the target test intervals. The wellbore images may provide better resolution than the petrophysical analysis and cluster analysis.

The example process 700 further determines horizontal stress anisotropy at the target test intervals (block 714). Horizontal stress anisotropy, defined as the difference between the minimum horizontal stress and the maximum horizontal stress, affects pressures required to initiate fractures at the wellbore wall. As the difference in the horizontal stresses increases, the fracture breakdown pressure decreases. Horizontal stress anisotropy may be inferred from image logs from the presence or absence of induced fractures. Test intervals with induced fractures may have a low minimum horizontal stress and/or a high degree of horizontal stress anisotropy. In either case, creating fractures with the MDT tool 350 is easier in such test intervals. In contrast, when no induced fractures are present, the test interval may have a higher minimum horizontal stress and/or lower horizontal stress anisotropy, either of which is likely to increase the pressure that must be applied by the MDT tool 350 to create a fracture in the test interval.

Dipole sonic logs may additionally or alternatively be used to identify horizontal stress anisotropy. An acoustic scanning platform (e.g., Schlumberger's Sonic Scanner) may be particularly useful to identify small degrees of horizontal stress anisotropy. Use of an acoustic scanning platform may enhance stress-test depth selection in test intervals having similar petrophysical properties. Such test intervals may have similar minimum horizontal stresses, but more anisotropic sections may have lower fracture breakdown pressures. By identifying the more anisotropic sections via the acoustic scanning platform, one or more of multiple test intervals having similar petrophysical properties may be selected for stress-testing before others of the test intervals.

After evaluating the test intervals (blocks 708-714), the example process 700 determines the anticipated stresses (e.g., breakdown pressures, closure stresses) of the target test intervals and test sequences the test intervals from lower anticipated stress to higher anticipated stress (block 716). The test interval order is used in the example process 600 to stress-test the target test intervals. After determining the test interval test sequence, the example process 700 ends and control returns to block 608 of FIG. 6A.

Figure 8A:
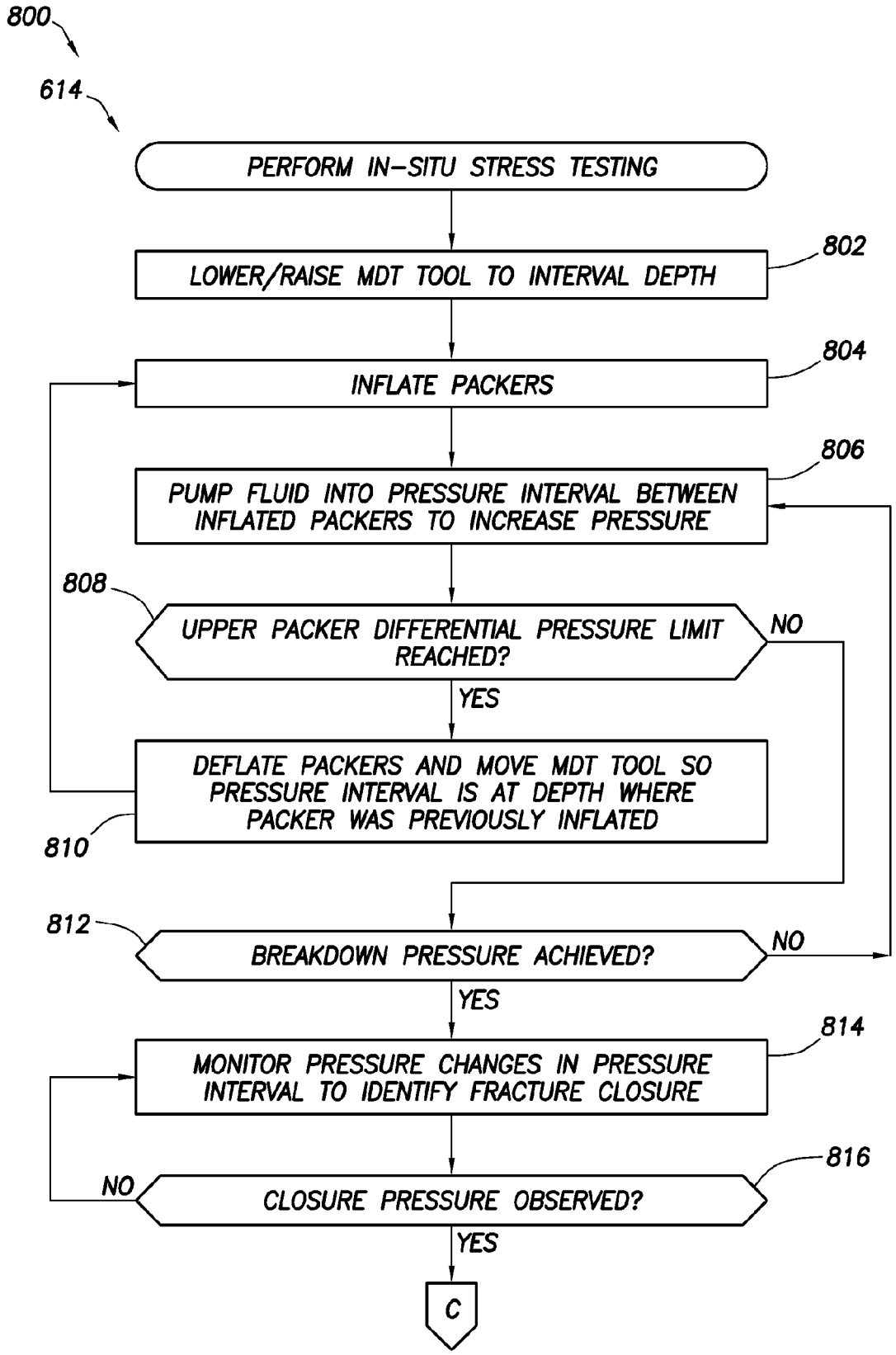
FIGS. 8A and 8B depict an example process to perform in-situ stress-testing according to one or more aspects of the present disclosure.
Figure 8B:
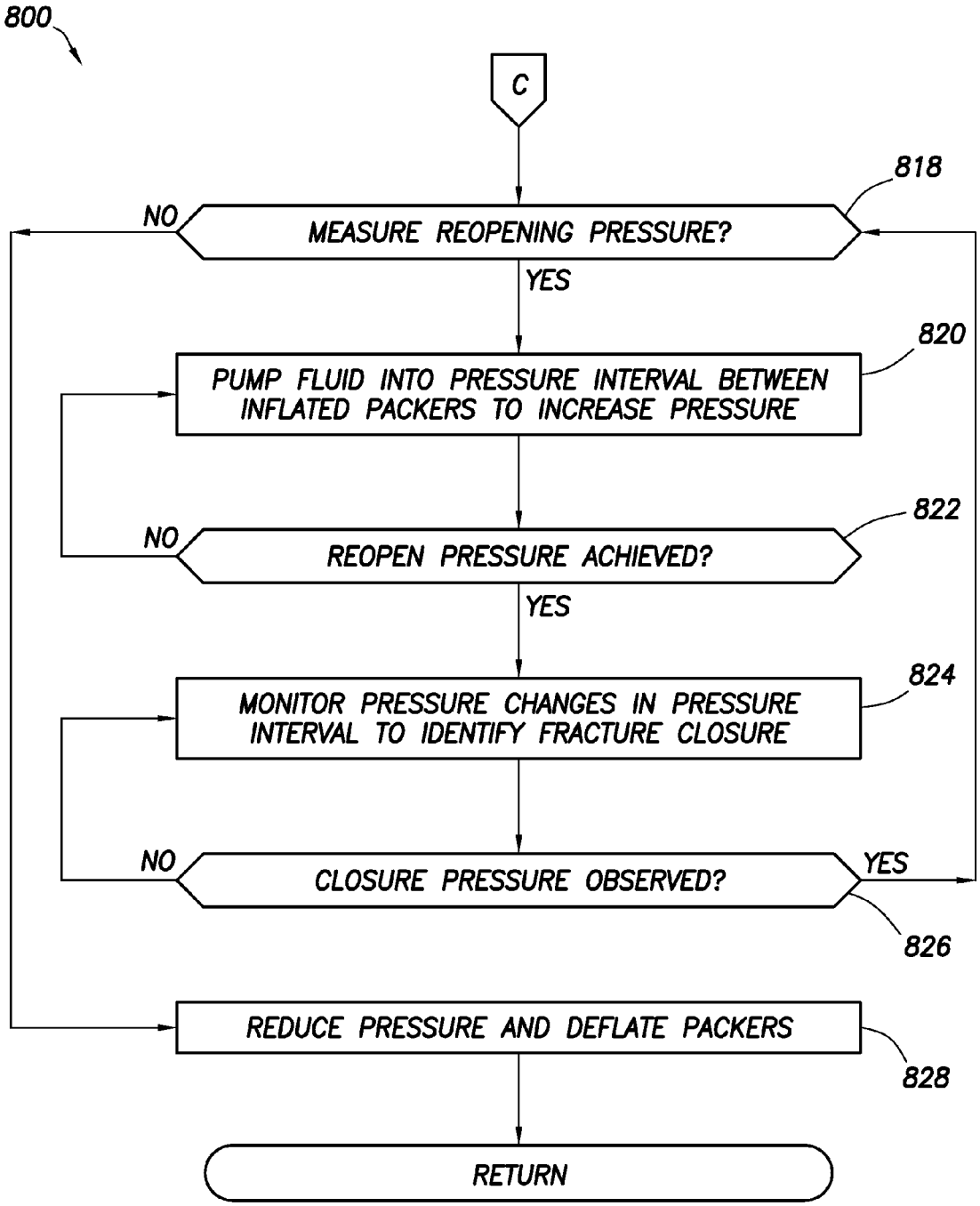

FIGS. 8A and 8B depicts an example process 800 to perform in-situ stress-testing according to one or more aspects of the present disclosure. The example process 800 may be used to implement, for example, the MDT tool 350 of FIG. 4 and/or block 614 of FIG. 6.

As described above with reference to FIGS. 6A and 6B, test interval identification and ordering is performed prior to deploying the MDT tool (e.g., the MDT tool 350 of FIG. 3B) to perform stress-testing. The example process 800 begins by lowering or raising the MDT tool 350 to the depth or level of the selected test interval (block 802). The MDT tool 350 inflates the packers 310 and 311 to create a hydraulic seal between a pressure interval (e.g., the pressure interval 305 of FIG. 3B) between inflated packers (e.g., the packers 310 and 311 of FIG. 3B) and the remainder of the wellbore (block 804). An increase in packer differential pressure indicates that the packers 310 and 311 are seated against the open hole. At this point, an increase in the test interval pressure as the packer pressure increases is an indication that the packers 310 and 311 have isolated the test interval from hydrostatic pressure. The pressure readings caused by the inflation of the packers 310 and 311 is illustrated as event 1310 in FIG. 13.

Next, the example process 800 pumps fluid into the pressure interval 305 between the inflated packers 310 and 311 to increase pressure on the formation (block 806). An example range of pressure interval 305 fluid injection rates may be 0.10 to 0.35 gallons per minute (i.e., 0.38 to 1.32 liters per min), depending on the injection pressure. In many shale formations, low injection rates are not an issue because leakoff is substantially non-existent. Low injection rates also reduce the likelihood of fractures growing past the packers 310 and 311, which may result in a pressure decline during drawdown (as explained in further detail below) that is more appropriate for determining closure stress. Further, appropriate fracture geometries may be more readily achieved at low fluid injection rates in very low permeability shale reservoirs.

Figure 10:
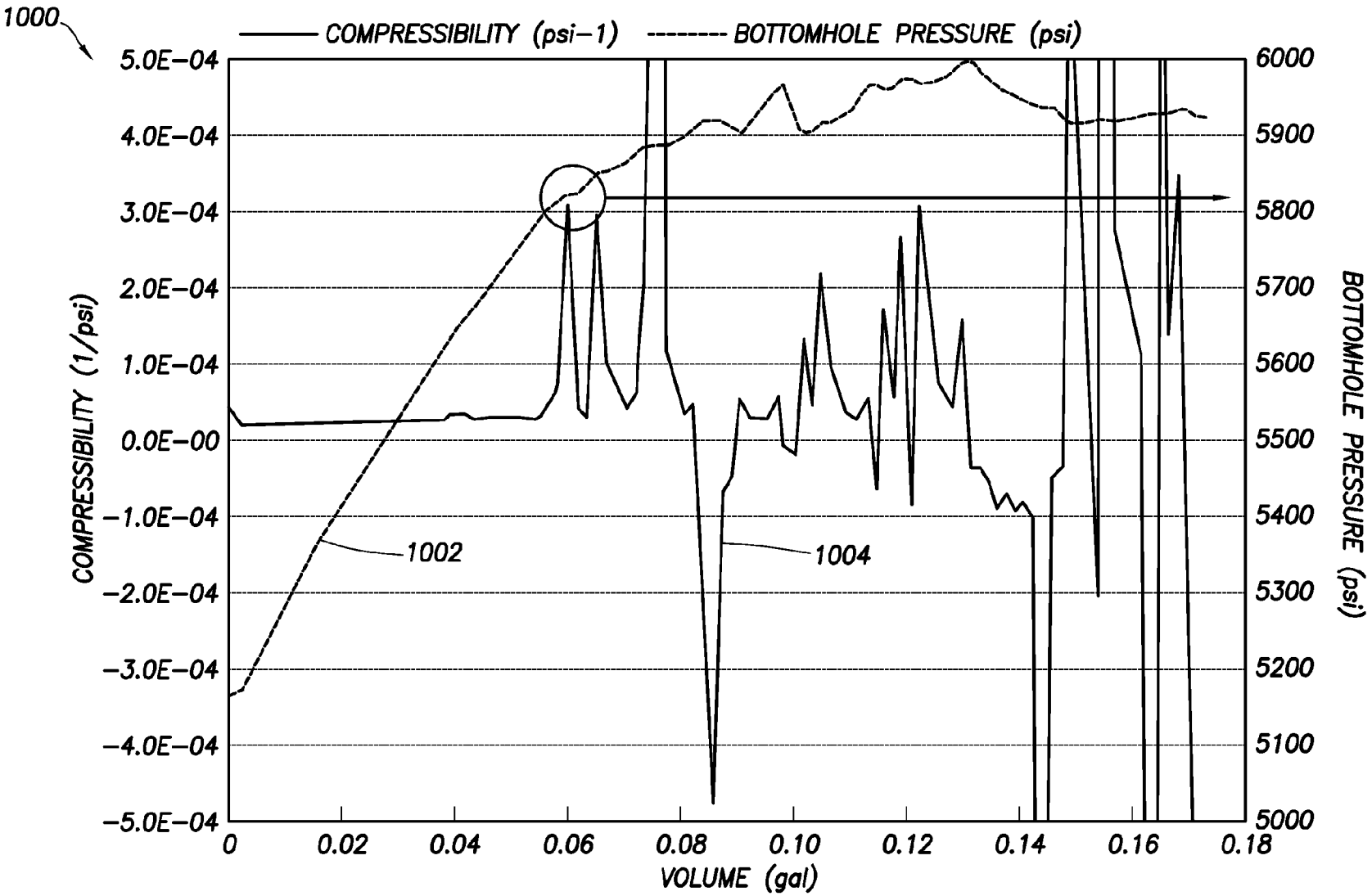
FIG. 10 is a graph depicting an example relationship between measured bottomhole pressure and predicted fluid compressibility according to one or more aspects of the present disclosure.

For the example MDT tool 350 configuration(s) deployed in the described example tests, the fluid injection rate declines as the bottomhole pressure increases. Thus, fracture initiation pressure may be more difficult to determine if no breakdown is observed. Because of the small test interval, volume compressibility of the fluid is very low. As illustrated in FIG. 10, comparing wellbore compressibility to pressure may be used to determine when the test interval volume has changed, which indicates that a fracture may have occurred. When the test interval volume is constant (i.e., when no hydraulic fracture is created), the wellbore compressibility is also substantially constant. However, when the test interval volume increases due to the creation of a hydraulic fracture, the compressibility changes appreciably.

The example process 800 then determines whether the upper limit on differential packer pressure has been reached (block 808). If the upper differential pressure limit is reached and no breakdown has been achieved, the MDT tool 350 is moved up or down to isolate the test interval where one of the packers 310 or 311 has previously been inflated (block 810). The inflation of the packers 310 and 311 puts the wellbore wall into tension and may cause tensile failure. Fractures caused by the inflation of the packers is referred to as "sleeve fracturing," and may be effective at creating breakdowns when the initial in-situ stress-test test interval did not create a fracture. Sleeve fracturing has been successfully applied for test interval selection and testing in several Barnett Shale wells and may result in successful fracturing of a wellbore wall.

If the upper differential pressure limit is not achieved (block 808), the example process 800 determines whether the breakdown pressure was achieved (block 812). As referred to above and described with reference to FIG. 10, breakdown pressure may be recognized by a change in wellbore compressibility. An example of a breakdown may be observed as event 1312 in FIG. 13. If the breakdown pressure is not yet achieved (block 812), control returns to block 806 to continue increasing the pressure on the formation. If the breakdown pressure has been achieved (block 812), the example process 800 monitors pressure changes in the pressure interval 305 to identify a closure of the fracture (block 814). Reducing the pressure may be performed by, for example, shutting down the pumpout module 352 (FIG. 3B) to reduce the pressure on the formation, by performing a hydraulic impedance test, by performing an impulse test, and/or by any other test or method of observing a closure of the fracture. As the pressure is reduced, the fracture in the wellbore wall closes at a closure stress. The process 800 then determines whether the closure stress is observed (block 816). If the closure stress is not yet observed (block 816), control returns to block 814 to continue reducing pressure and monitoring. Additionally or alternatively, the example process 800 may perform a hydraulic impedance test by reducing the pressure to cause the fracture to close. The pressure is then monitored to determine at what pressure the fracture reopens.

If the closure stress is observed (block 816), control passes to block 818 in FIG. 8B to determine whether to measure a reopening pressure. As described in conjunction with FIG. 12, the pressure needed to reopen the fracture after closing is less than the initial breakdown pressure. The example graph 1200 of FIG. 12 further illustrates multiple reopenings of the fracture at a test interval. For each injection cycle, fracture breakdown pressure, fracture propagation pressure, instantaneous shut-in pressure (ISIP), fracture closure pressure, and fracture reopening pressure may be identified to narrow the range for minimum in-situ stress. An advantage of the example downhole injection stress-testing techniques is that multiple injections, each representing different fluid injection rates and/or volumes may be performed at multiple selected test intervals. The observed pressure response may then be analyzed (e.g., via the analyzer 402 of FIG. 4) in combination with logs and images to determine fracture closure pressure, understand the fracture pattern created and the vertical extent of fractures.

If the fracture is to be reopened (block 818), the MDT tool 350 pumps fluid into the pressure interval 305 to increase the pressure on the formation at the test interval (block 820). Block 820 may be performed in a manner similar or identical to that of block 806 in FIG. 8A). Successive test interval injections may result in lower fracture reopening pressures, an example of which is illustrated as event 1314 in FIG. 13. The example process 800 then determines whether the reopening pressure is achieved (block 822). If the reopening pressure is not achieved (block 822), control returns to block 820 to continue to increase pressure. If the reopening pressure is achieved (block 822), the example MDT tool 350 monitors pressure changes in the pressure interval 305 to identify a closure of the fracture (block 824). The example process 800 then determines whether the closure stress is achieved (block 826). If the closure stress is not achieved (block 826), control returns to block 824 to further reduce the pressure in the pressure interval 305. Blocks 822-826 may be implemented in substantially the same way as blocks 812-816 of FIG. 8A.

If the closure stress is achieved (block 826), control returns to block 818 to determine whether to re-measure the reopening pressure. As mentioned above, reopening the fracture provides additional data to determine the closure stresses. If the process 800 determines that the reopening pressure is not to be re-measured (block 818), the MDT tool 350 reduces pressure and deflates the packers 310 and 311 so that the MDT tool 350 may be moved or removed (block 828). The example process 800 may then return control to block 616 of the example process 600 of FIG. 6A.

Reopening the fracture provides a direct way to measure the tensile strength of the rock and can be compared with compressive strength values obtained using cores to develop a correlation between unconfined compressive strength and tensile strength. Having an estimate of the tensile strength also enables the analyzer 402 (FIG. 4) to calculate maximum horizontal stress to quantify the degree of horizontal stress anisotropy. Assuming linear elasticity and that the injected fluid is non-penetrating, the tensile strength can be estimated by Equation 1:

$$P_i = 3\sigma_h - \sigma_H + T - P_r \qquad \text{Eq. 1}$$

Figure 12:
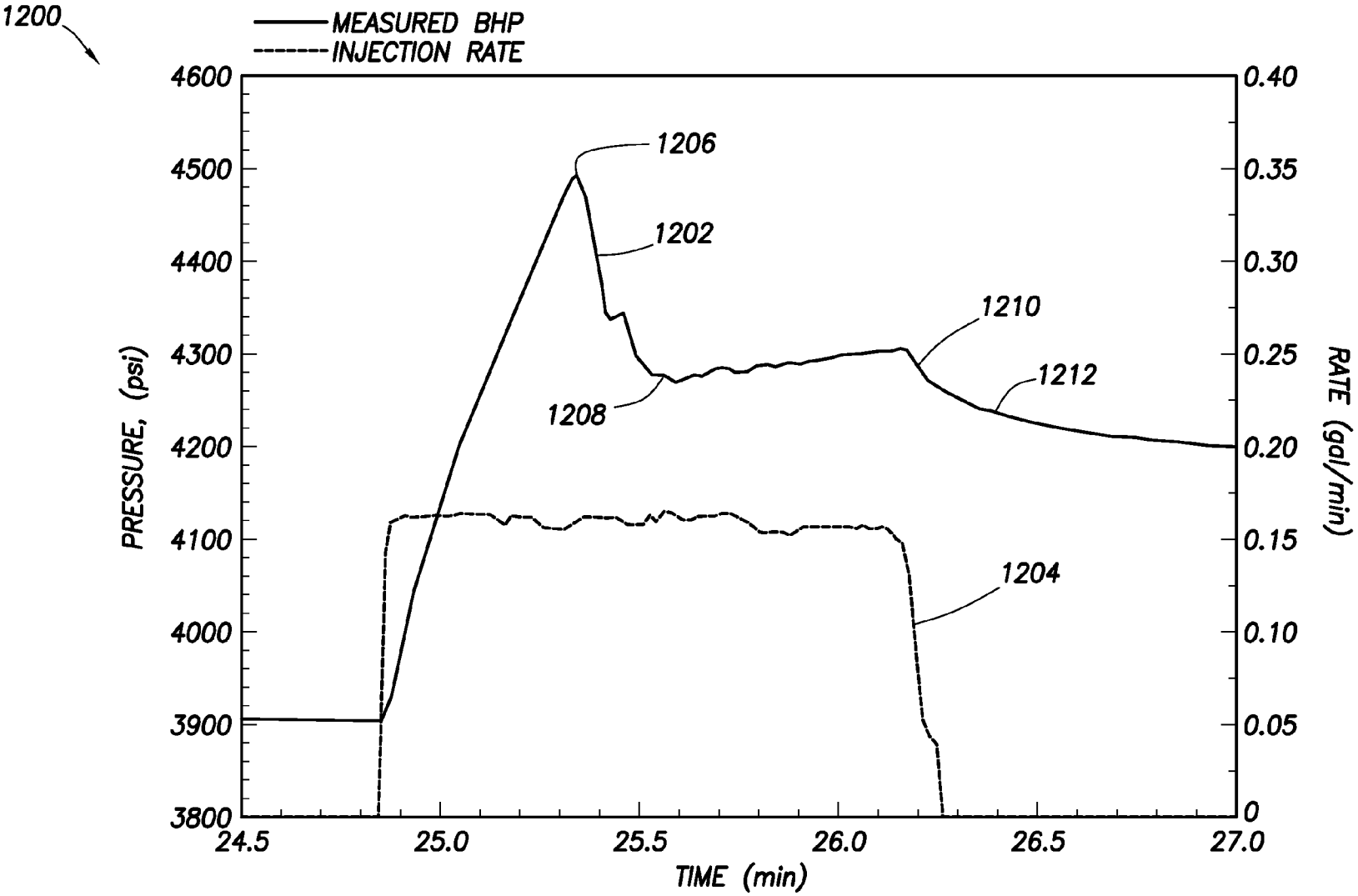
FIG. 12 is a graph depicting an example bottomhole injection according to one or more aspects of the present disclosure.
Figure 13:
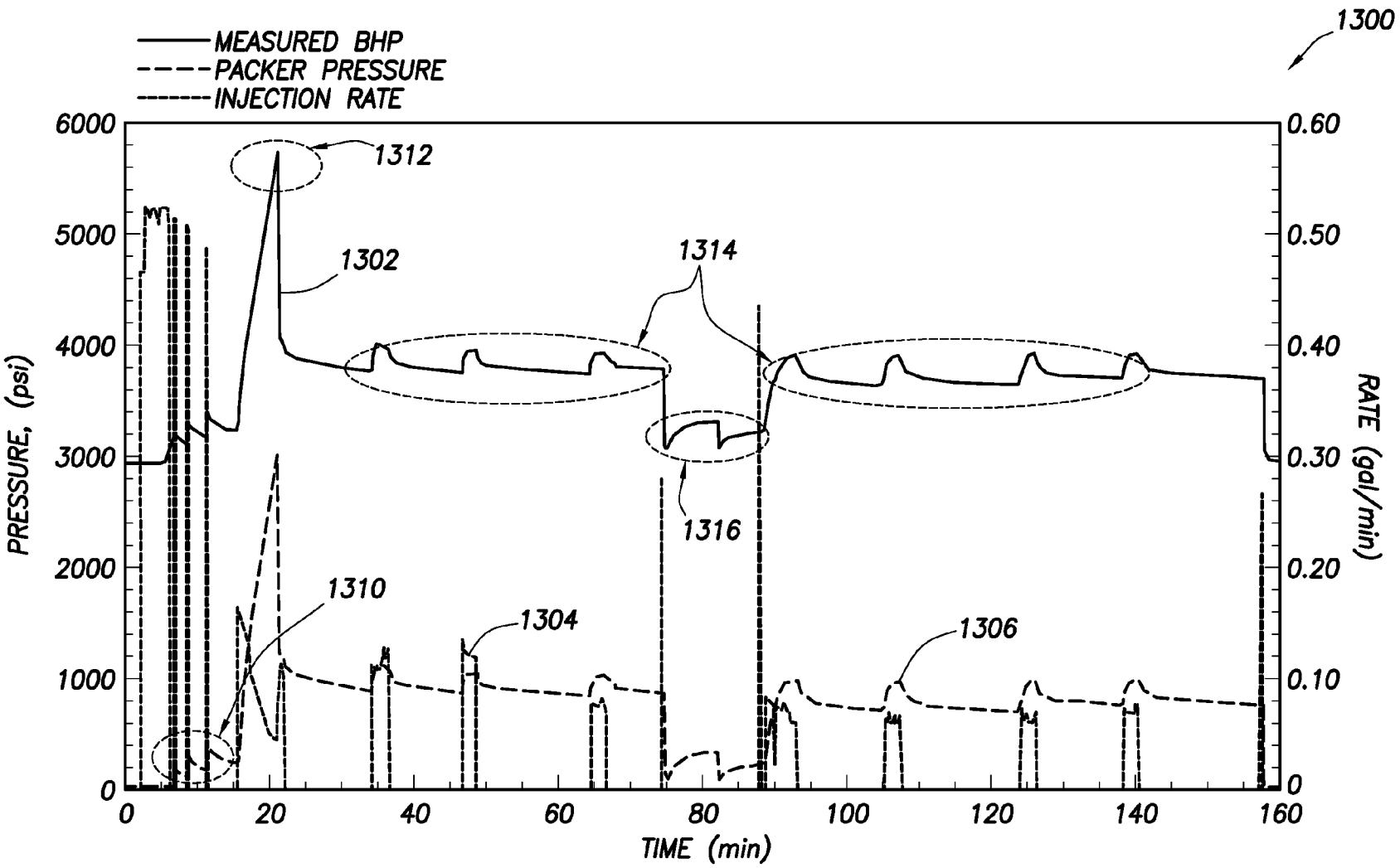
FIG. 13 is a graph depicting example injection cycles according to one or more aspects of the present disclosure.

In Equation 1, $P_i$ is the fracture breakdown pressure (psi), $\sigma_h$ is the minimum horizontal stress (i.e., minimum in-situ stress, closure pressure, or fracture closure stress), $\sigma_h$ is the maximum horizontal stress, T is the tensile strength of the rock, and $P_r$ is the pore pressure. The difference between the initial breakdown pressure (e.g., event 1310 in FIG. 13) and the fracture reopening pressure (e.g., event 1314 in FIG. 13) is an approximation of the tensile strength because it is assumed to be effectively zero during the reopening. By determining the tensile strength in this manner and fracture closure pressure from the pressure decline analysis, an estimate of the maximum horizontal stress can be made from Equation 1 if a reliable estimate of pore pressure is available. FIG. 12 shows an example from an injection cycle performed in the Barnett Shale. An analysis similar to the one illustrated in FIG. 11 may be performed for the injection described in FIGS. 8A and 8B, thereby providing an accurate estimate of minimum in-situ stress. As the example stress tests allow for multiple injections into the formation at a given depth, it is possible to estimate the tensile strength of the rock where there is no impact from induced fractures, natural fractures, complex hydraulic fractures, or shear fracturing. An example is shown in FIG. 13 where multiple injections are applied into an Ellenberger test interval.

Figure 9:
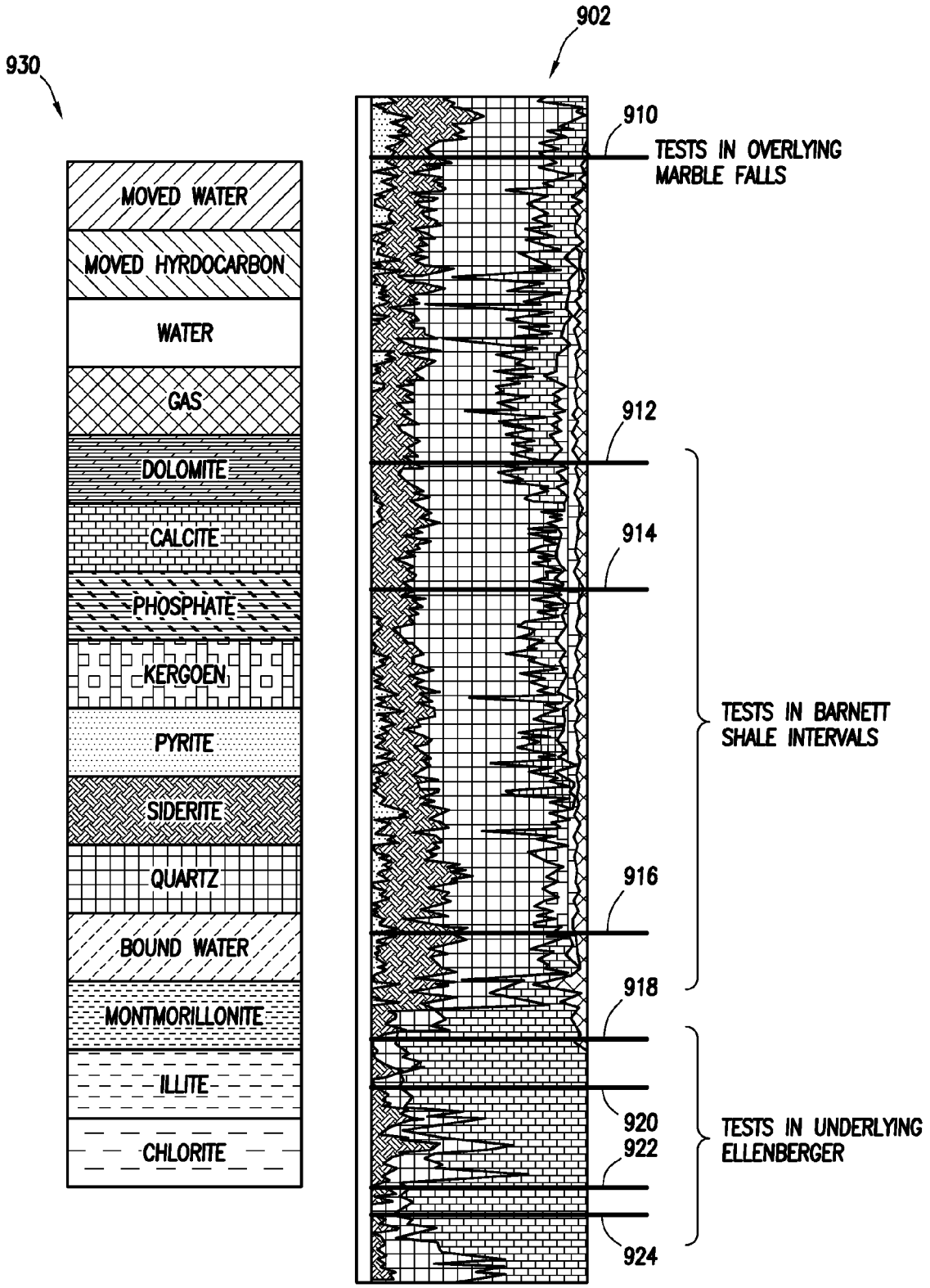
FIG. 9 depicts a mineralogy track showing example selected test intervals in the Fort Worth Basin Barnett Shale according to one or more aspects of the present disclosure.

FIG. 9 depicts a mineralogy track 904 showing example selected test intervals 910-924 in the Fort Worth Basin Barnett Shale according to one or more aspects of the present disclosure. In addition to the Barnett Shale formation, the example mineralogy track 904 shows petrophysical properties of an overlaying Marble falls formation and an underlying Ellenberger carbonate formation. The example mineralogy track 904 may be created based on wireline logging tests to determine petrophysical properties of a formation (e.g., a shale formation) as described in conjunction with FIGS. 6A and 6B. The logging tests may include a geochemical log to estimate mineralogy. A mineralogy key 930 indicates which types of minerals and/or rock types are located in each portion of the mineralogy track 904.

The example test intervals 910-924 are selected based on an analysis of formation mineralogy results from the wireline logging as described in conjunction with FIGS. 7A and 7B. Each of the test intervals 910-924 corresponds to and/or is similar to the pressure interval 305 of FIG. 3B and represent locations (e.g., depths) within the rock formation for the MDT tool 350 to perform in-situ stress tests as described in conjunction with FIGS. 8A and 8B. In the example of FIG. 9, the test intervals 910-924 are divided into zones that are estimated to have comparable closure stresses so that actual measured closure stress performed by the MDT tool 350 of FIG. 3B is representative of the whole zone. For example, the test interval 910 is selected to be tested in the Marble Falls formation, the test intervals 912-916 are selected to be tested in the Barnett Shale formation, and the test intervals 918-924 are selected to be tested in the Ellenberger formation.

The test intervals 910-924 may be adjusted to account for variable features determined from image logs that are not detectable with a petrophysical evaluation. Further, the locations of the example test intervals 910-924 are selected so that very thin sections of the mineralogy track 904 are not tested because the closure stress in a thin zone is not likely to impact hydraulic fracture height during actual stress testing. The mineralogy track 904 may be compared to one or more sonic logs to determine indications of horizontal stress anisotropy. The test intervals 910-924 may then be located on the mineralogy track 904 by these indications because a fracture is more likely to occur at a wellbore wall with horizontal stress anisotropy.

Additionally, to maximize operational efficiency of the in-situ stress testing process of the example MDT tool 350 of FIG. 3B, the example test intervals 910-924 of FIG. 9 may be arranged in a test sequence so that the test intervals with the lowest anticipated closure stress are selected to be tested first. Testing the intervals 910-924 based on lowest stress level minimizes the differential pressure imposed on the packers 310 and 311 (FIG. 3B) early in the testing sequence. Based on this test sequence, if the packers 310 and 311 were to fail under a relatively high differential stress, many of the test intervals would have already been tested.

FIG. 10 is a graph 1000 depicting an example relationship between measured bottomhole pressure 1002 and predicted fluid compressibility 1004 according to one or more aspects of the present disclosure. In the example of FIG. 10, wellbore compressibility 1004 is expressed as the inverse of pressure (e.g., 1/psi) and bottomhole pressure is expressed as pressure (e.g., psi). Comparing the wellbore compressibility 1004 to the bottomhole pressure 1002 may be used to determine when a volume of fluid within the pressure interval 305 of FIG. 3B has changed during in-situ stress testing and/or closure stress formation testing by the example MDT tool 350. A change in volume indicates that a fracture has been formed in a wellbore wall.

When the volume of the pressure interval 305 is constant (e.g., when there is no hydraulic fracture), the wellbore compressibility 1004 is constant. In the example graph 1000, the wellbore compressibility 1004 is constant from 0.00 gallons to approximately 0.055 gallons. Alternatively, when the volume of the pressure interval 305 increases due to the creation of a hydraulic fracture in the wellbore wall 302, the compressibility 1004 of the fluid in the pressure interval 305 changes appreciably. The example graph 1000 shows that when the bottomhole pressure 1002 is approximately 5,820 psi with approximately 0.055 gallons of fluid in the pressure interval 305, the compressibility 1004 begins to change appreciably. This change in the compressibility 1004 indicates that a hydraulic fracture has occurred in the wellbore wall 302. The bottomhole pressure 1002 at the start of the change in the compressibility 1004 (e.g., 5,820 psi) may be used during an analysis of MDT tool data to determine the minimum pressure needed to initiate a hydraulic fault in that section of the wellbore wall.

Figure 11:
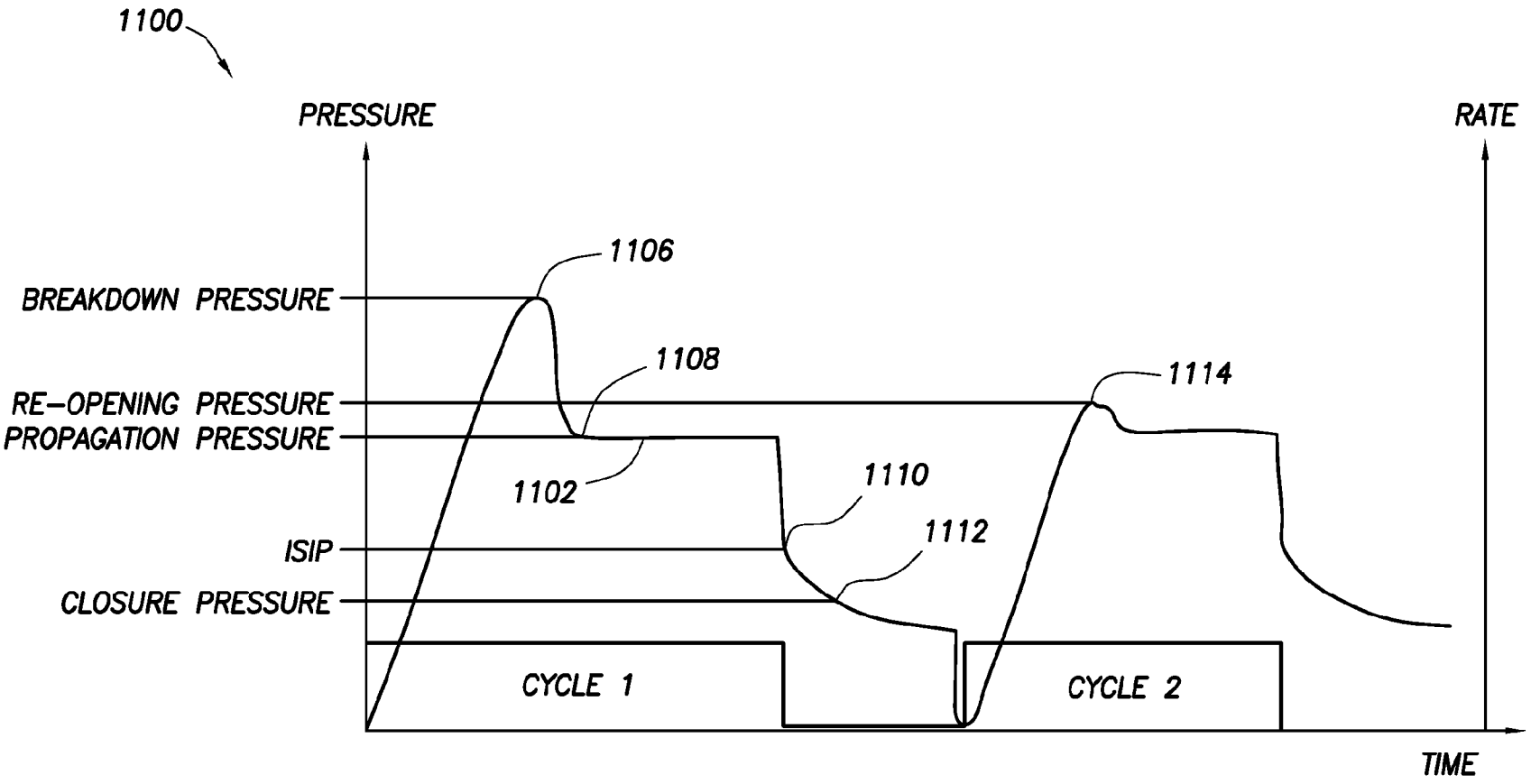
FIG. 11 is a graph depicting an example pressure response during bottomhole injection according to one or more aspects of the present disclosure.

FIG. 11 is a graph 1100 depicting an example predicted and/or modeled pressure response 1102 during bottomhole pressure injection according to one or more aspects of the present disclosure. The bottomhole pressure injection (e.g., in-situ stress testing) may be performed by the example MDT tool 350 of FIG. 3B at selected test intervals (e.g., the test intervals 910-924 of FIG. 9). The example pressure response 1102 is shown for a first cycle (e.g., Cycle 1) and a subsequent second cycle (e.g., Cycle 2).

The example graph 1100 shows that for the Cycle 1, the predicted pressure response 1102 increases initially from a starting pressure until a breakdown pressure point 1106 indicating the initialization of a hydraulic fault in a wellbore wall. The predicted pressure response 1102 shows that from the breakdown pressure point 1106 until a propagation pressure point 1108 the pressure drops quickly as fluid escapes into a newly opened hydraulic fault. Then, from the propagation pressure point 1108, the pressure response 1102 is approximately constant as equilibrium is established between the fluid in the pressure interval 305 (FIG. 3) and the fluid in the hydraulic fault. Next, at an instantaneous shut-in pressure (ISIP) point 1110, the Cycle 1 stops and the pressure applied by the MDT tool 350 to the test interval is removed. At this ISIP point 1110, the pressure response 1102 indicates the pressure decreases quickly. This decrease is slowed at a closure pressure point 1112 where pressurized fluid in the hydraulic fault flows back into the pressure interval 305 as the hydraulic fault closes. The example pressure response 1102 then shows that the pressure returns to the starting pressure.

The example predicted pressure response 1102 shows that during the Cycle 2, the pressure in the pressure 305 interval increases quickly as the pressure is applied by the MDT tool 350. However, the pressure response 1102 indicates that at a reopening pressure point 1114, the pressure required to open the hydraulic fault has decreased from the Cycle 1. The pressure at the reopening pressure point 1114 may be less than the pressure at the breakdown pressure 1106 because the hydraulic fault at the reopening pressure point 1114 has already been initially opened at the breakdown pressure point 1106 and thus, less pressure is required to reopen the fault. In other words, after the breakdown pressure point 1106, the tensile strength of the formation has been overcome to initiate a fracture. The observed pressure response 1102 may be analyzed by the example analyzer 402 of FIG. 2 to determine fracture closure pressure to understand the fracture pattern created to and understand the vertical extent of the fractures.

The pressure response 1102 shown in the graph 1100 of FIG. 11 may not represent pressure response by every in-situ stress test performed by the MDT tool 350. For example, hydraulic fracturing of highly laminated shale results in unexpected pressure responses. Further, the MDT tool 350 may be utilized to perform multiple injections with differing pressure injection rates and/or volumes that result in different pressure responses than the pressure response 1102 shown in FIG. 11.

FIG. 12 is a graph 1200 depicting an example bottomhole injection pressure response 1202 according to one or more aspects of the present disclosure. The pressure response 1202 shows an actual pressure response measured by the MDT tool 350 during an injection cycle 1204 in the Barnett formation. In this example, the pressure response 1202 is shown as psi and the fluid injection rate 1204 is shown as gal/min. The measured pressure response 1202 (e.g., Measured BHP) is similar to the predicted pressure response 1102 of FIG. 11. Additionally, the measured pressure response 1202 shows a breakdown pressure point 1206 at a relatively similar location to the predicted breakdown pressure point 1106. Likewise, the measured pressure response 1202 includes a propagation pressure point 1208, an ISIP point 1210 and a closure pressure point 1212 at relatively similar locations to the respective pressure points 1108-1112 on the predicted pressure response 1102.

FIG. 13 is a graph 1300 depicting example injection cycles and a measured pressure response 1302 according to one or more aspects of the present disclosure. The graph 1300 shows the measured test interval pressure response 1302 in relation to a fluid injection rate 1304 and a measured packer pressure 1306. The example MDT tool 350 of FIG. 3B may inject fluid into the pressure interval 305 of FIG. 3B. Additionally, the pressure gauges 308*a-b* included within the MDT tool 350 may measure the pressure within the respective packers 310 and 311.

FIG. 13 shows that multiple pressure injections may be performed on the pressure interval 305 to estimate a tensile strength of the rock formation F where there is no impact from induced fractures, natural fractures, complex hydraulic fractures, and/or shear fractures. For example, the graph 1300 shows that at an event 1310 the MDT tool 350 is moved to the pressure interval 305 and the packers 310 and 311 are inflated with wellbore fluid. An increase in the measured packer pressure 1306 during the event 1310 indicates that the packers 310 and 311 are seated against the wellbore wall 302. An increase in the measured pressure response 1302 as the measured packer pressure 1306 is increased indicates the packers 310 and 311 have isolated the pressure interval 305 from hydrostatic pressure. After pumping ceases at the MDT tool 350, as indicated by a decrease in the injection rate 1304 during the event 1310, the packer pressure 1306 and the test interval pressure 1302 declines are monitored. Relatively little packer pressure 1306 and test interval pressure 1302 decline indicates a good hydraulic seal.

After ensuring that the packers 310 and 311 are seated against the wellbore wall 302, the MDT tool 350 injects fluid into the pressure interval 305 to initiate a fracture. The fracture is shown by the decrease in the test interval pressure response 1302 and the measured packer pressure 1306 during the event 1312. An event 1314 shows that at some time later, the measured test interval pressure response 1302 indicates reopening pressure points, thereby indicating the fracture has reopened. The initial breakdown pressure at the event 1312 is higher than the subsequent reopening pressures during the event 1314 because the initial breakdown pressure overcomes the tensile strength of the formation. The subsequent lower pressures to reopen the fracture shown in the pressure response 1302 in event 1314 and the initial breakdown pressure in event 1312 provide a direct way to measure the tensile strength of the rock formation F in FIG. 3B (and/or any other rock formation) and may be compared with compressive strength values to develop a correlation between unconfined compressive strength and tensile strength. An estimate of the tensile strength enables the analyzer 402 of FIG. 4 to calculate maximum horizontal stress to quantify the degree of horizontal stress anisotropy in the rock formation F. The difference between the initial breakdown pressure during the event 1312 and the fracture reopening pressure shown by the local peaks of the pressure response 1302 during the event 1314 provide an approximation of the tensile strength.

The example graph 1300 of FIG. 13 also shows an event 1316 that corresponds to a hydraulic impedance test. The hydraulic impedance test includes using the MDT tool 350 to draw fluid out of the fluid-filled open fracture at such a rate that the MDT tool 350 forces the fracture to close quickly at the wellbore wall 302. The MDT tool 350 then stops the fluid withdrawal resulting in a pressure increase and a reopening of the fracture as shown by an increase in pressure of the test interval pressure response 1302 during the event 1316. Because the test interval pressure is drawn down to approximately hydrostatic pressure, the pressure increase as indicated by the pressure response 1302 indicates that fluid flow is occurring from a fracture that is likely closed, yet still permeable. This confirms that a fracture was created during the prior injections during the events 1312 and 1314.

Figure 14:
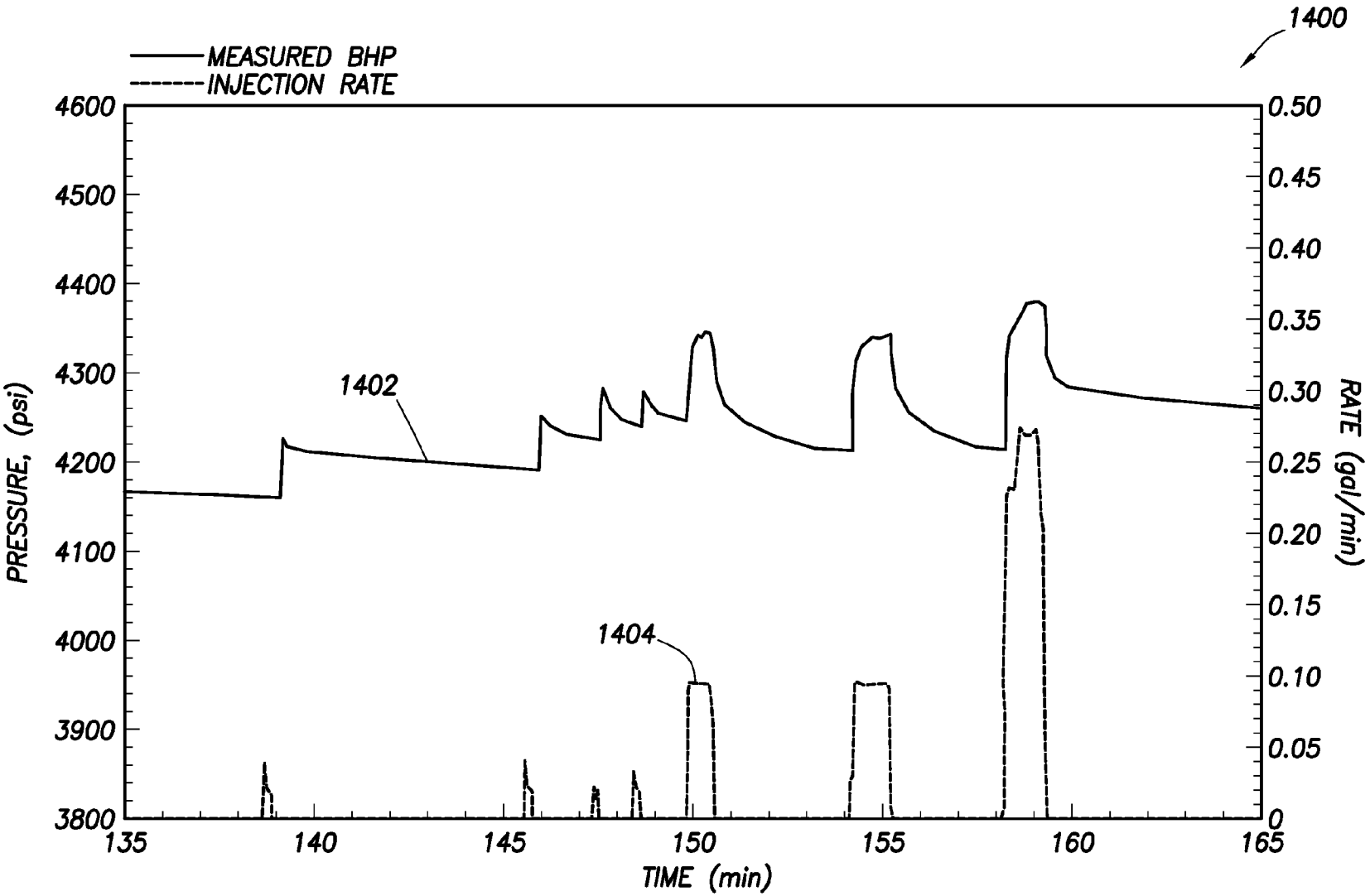
FIG. 14 is a graph depicting example impulse tests according to one or more aspects of the present disclosure.

FIG. 14 shows a graph 1400 depicting example impulse tests according to one or more aspects of the present disclosure. The example graph 1400 includes a measured bottomhole pressure (BHP) response 1402 and an applied fluid injection rate 1404. The pressure response 1402 is shown in psi and the injection rate 1404 is shown in gal/min. The example graph 1400 in FIG. 14 shows that the impulse tests may be performed by the MDT tool 350 of FIG. 3B to gradually increase the pressure in the pressure interval 305 until a fracture reopening pressure is reached. The impulse test is conducted when the pumpout module 352 applies pressure to the internal flowline 354 while the interval seal valve 358 is closed. Then, the valve 358 is opened and the pressure is applied to the pressure interval 305 (as shown by the spike during the first four square waveform of the injection rate 1404). The closing and opening of the valve 358 may be repeated until a fracture in the wellbore wall 302 is detected.

The measured pressure response 1402 shows that for the first four impulses starting at approximately 138 minutes, the pressure in the pressure interval 305 was not high enough to initiate a hydraulic fracture. The last three impulses starting at approximately 149 minutes were performed by leaving the interval valve 358 open and pumping fluid into the pressure interval 305 until a reopening pressure is identified. The pressure response 1402 shows that a reopening pressure of approximately 4,330 psi is needed to initiate a reopening of the fracture.

Figure 15:
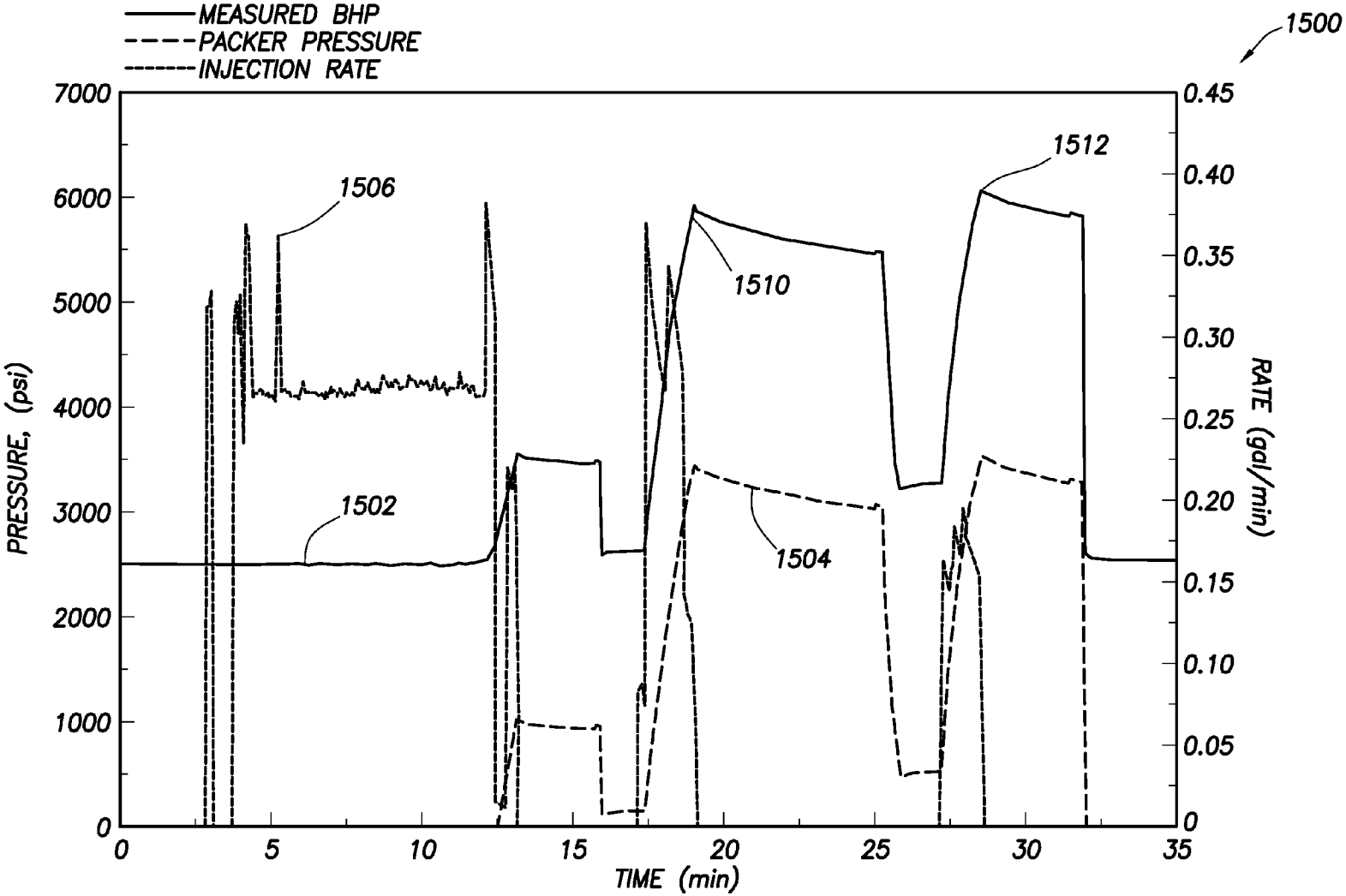
FIG. 15 is a graph depicting an example of an unsuccessful in-situ stress test according to one or more aspects of the present disclosure.

FIG. 15 shows a graph 1500 depicting an example of an unsuccessful in-situ stress test according to one or more aspects of the present disclosure. The example graph 1500 includes a measured bottomhole pressure (BHP) response 1502 shown in psi, a measured packer pressure 1504 shown in psi, and a fluid injection rate 1506 shown in gal/min. FIG. 15 shows that sleeve fracturing may be used to determine in-situ stress to initiate a fracture if tensile strength, a near wellbore stress concentration, or a closure stress are relatively high at the test interval causing an unsuccessful in-situ stress test. If these stresses are relatively high, the maximum pressure limit of the packers 310 and 311 may be reached before a fracture is initiated.

Other possible solutions to determine in-situ stress in these instances may include increasing the mud weight, perforating the test interval, and/or drilling sidewall core plugs. However, increasing the mud weight poses a risk of lost circulation. Additionally, perforating the test interval at 60 degree phasing may reduce the stress concentration.

The sleeve fracturing technique inflates the packers 310 and 311 to impart a tensile stress on the rock formation that may induce tensile failure. Isolating an interval (e.g., the pressure interval 305) for testing where packer inflation has occurred may result in a successful test when the adjacent, initial test did not create the fracture. FIG. 15 shows that two injections at points 1510 and 1512, which caused the pressure response 1502 to increase to approximately 6,000 psi, were inadequate to initiate a fracture. The pressure response 1502 indicates a fracture was not initiated because the pressure response 1502 does not show a breakdown pressure point, propagation pressure point, ISIP point, and/or a closing pressure point as shown in FIGS. 11-14.

Figure 16:
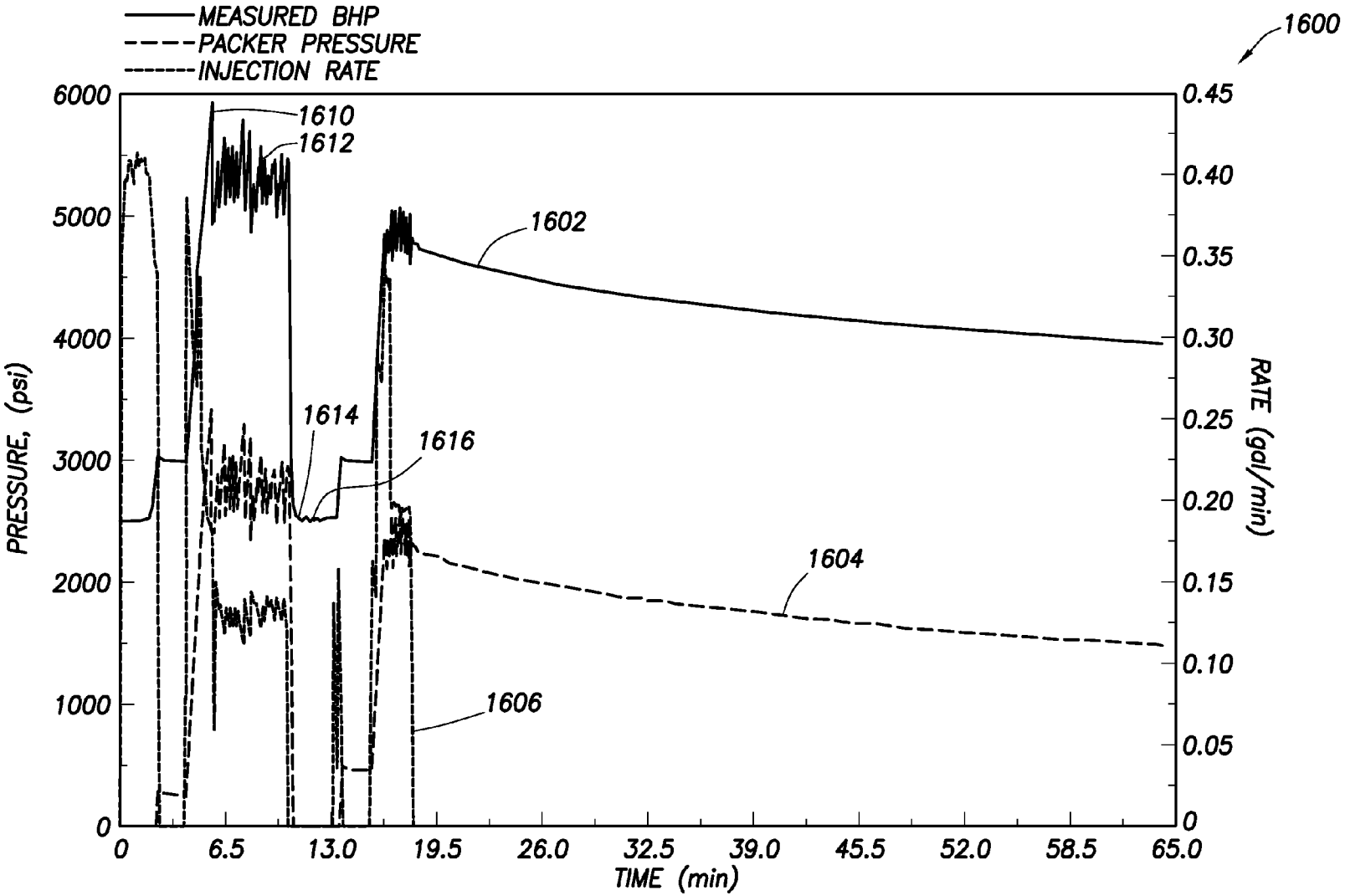
FIG. 16 is a graph depicting an example of successful sleeve fracturing according to one or more aspects of the present disclosure.

Because a fracture initiation did not occur, the MDT tool 350 was moved so that the pressure interval 305 included the previous location of the top packer 310. FIG. 16 shows a graph 1600 depicting a successful implementation of the sleeve fracturing technique according to one or more aspects of the present disclosure. The example graph 1600 includes a measured bottomhole pressure (BHP) response 1602 shown in psi, a measured packer pressure 1604 shown in psi, and a fluid injection rate 1606 shown in gal/min. The pressure response 1602 shows that a fracture was successfully created at the new test interval at a pressure less than 6,000 psi. A breakdown pressure point 1610, a propagation pressure point 1612, an ISIP point 1614, and a closure point 1616 indicate the successful initiation of the fracture.

Figure 17:
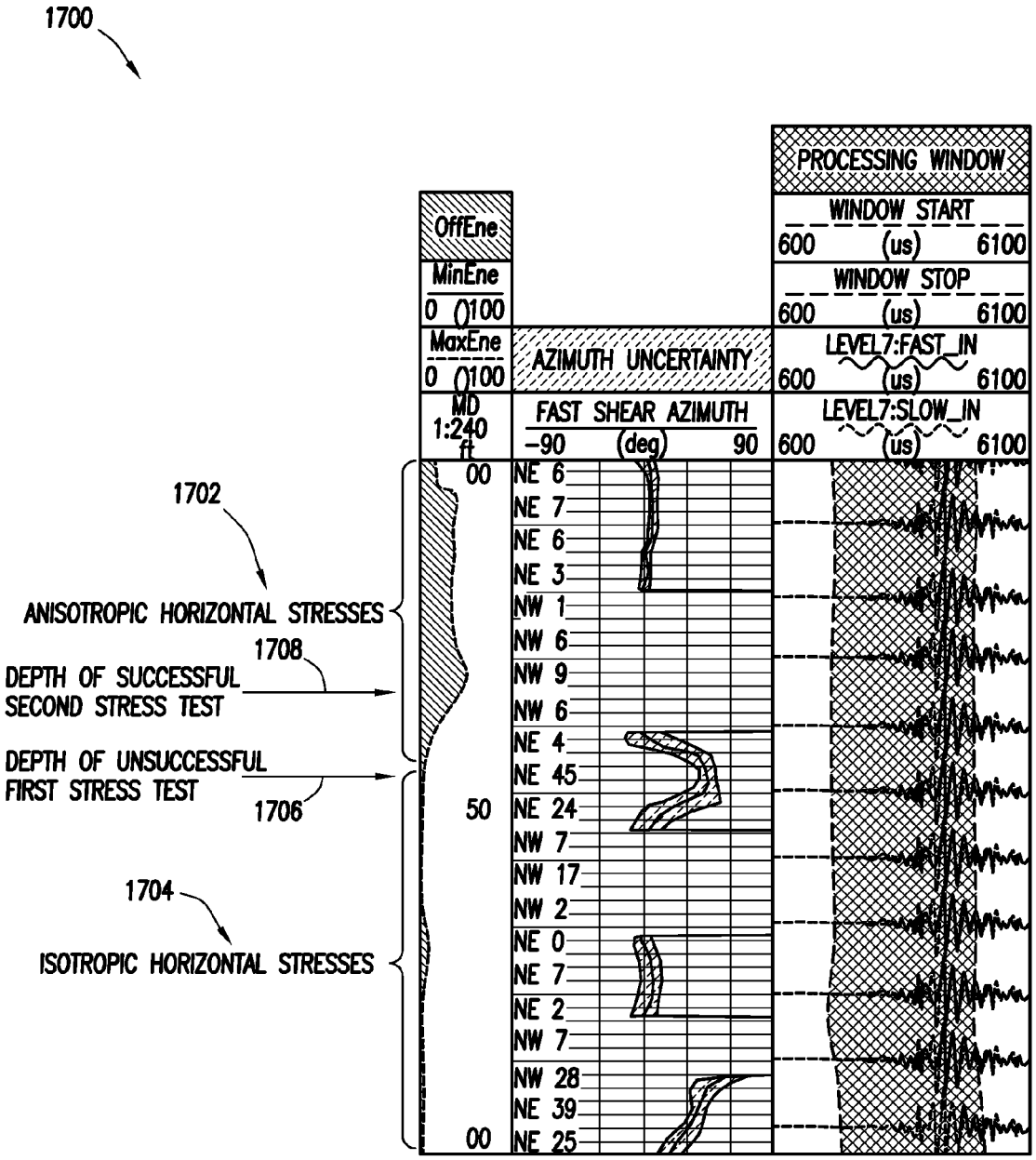
FIG. 17 depicts example acoustic measurements of horizontal stress anisotropy according to one or more aspects of the present disclosure.

FIG. 17 depicts example acoustic (i.e., sonic) measurements 1700 of horizontal stress anisotropy according to one or more aspects of the present disclosure. Horizontal stress anisotropy identified with the acoustic measurements 1700 may be used to aid in the test interval selection methodology. FIG. 17 illustrates the differences in horizontal stress anisotropy between a first section 1702 of the Barnett Shale and a second section 1704 of the Barnett Shale as identified from the acoustic measurements 1700. Anisotropy is present in the first example section 1702 of approximately forty feet, while the second section 1704 of the acoustic measurements 1700, measuring sixty feet, demonstrates isotropic behavior.

An analysis of the example acoustic measurements 1700 indicates that the petrophysical properties and the mineralogy over this example test interval including the first 1702 and second sections 1704 are relatively consistent. However, a downhole injection test performed in the second section 1704 at a first test marker 1706 was unsuccessful at initiating a fracture prior to reaching the maximum packer differential pressure. In this example, the MDT tool 350 was raised to the first section 1702 and placed at a second test marker 1708 where the most anisotropic behavior was identified from the example acoustic measurements 1700. The downhole injection test at the second marker 1708 was successful at creating a fracture and determining closure stress. The acoustically determined stress profile generated from the acoustic measurements 1700 indicated that this complete test interval was comparably stressed, as expected from the petrophysical analysis. Thus, the difference between conducting a successful and unsuccessful stress test was the identification of the horizontal stress anisotropy difference through the test interval with an advanced dipole sonic tool to generate the acoustic measurements 1700.

Figure 18:
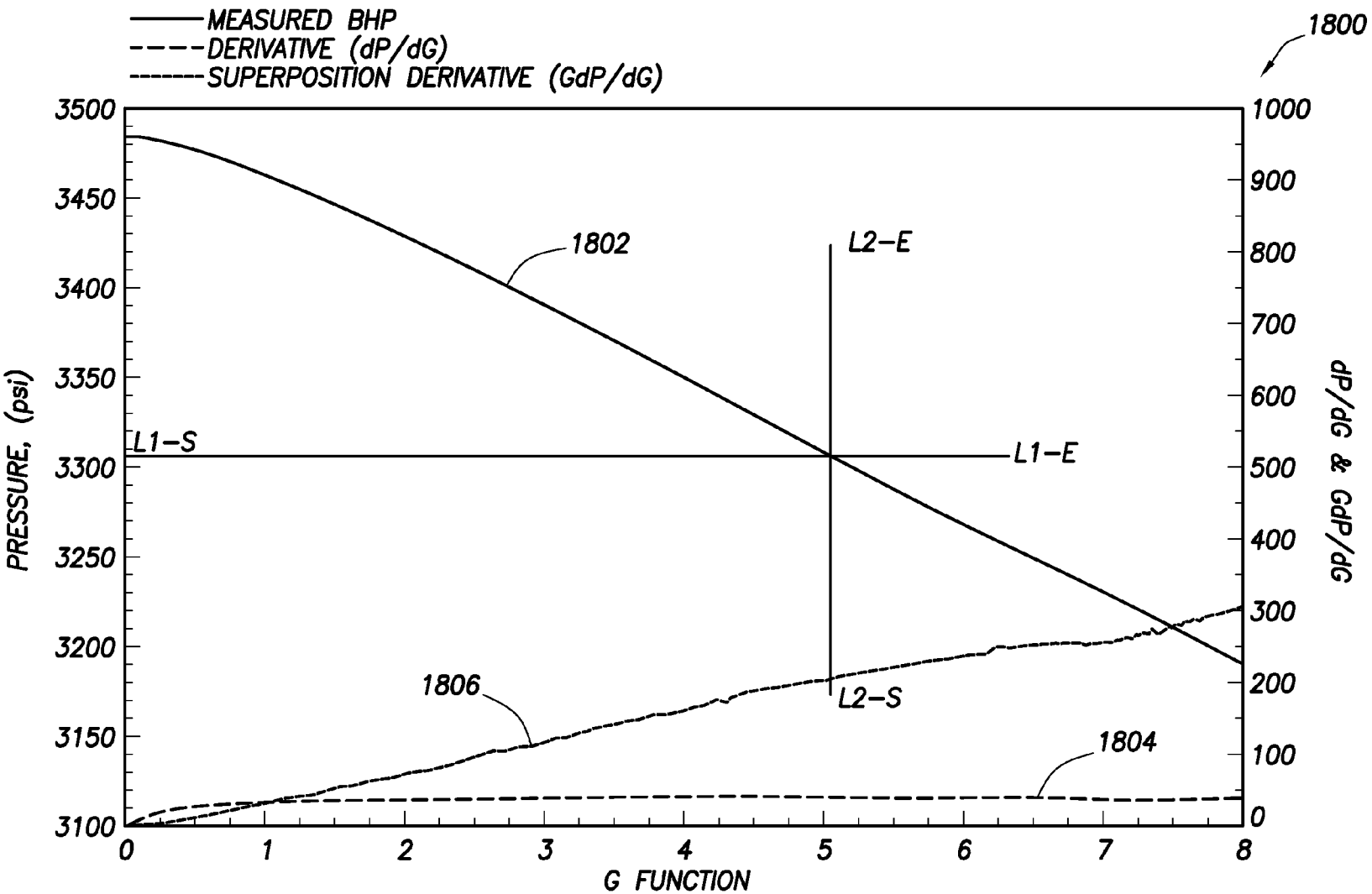
FIG. 18 is a graph depicting an example G function decline analysis plot according to one or more aspects of the present disclosure.

FIG. 18 shows a graph 1800 depicting an example G function decline analysis plot according to one or more aspects of the present disclosure. The G function decline analysis plot is used to determine the closure pressure from the bottomhole pressure. The example graph 1800 includes a plot of the measured bottomhole pressure 1802, a plot of the corresponding derivative 1804, and a plot of the corresponding superposition derivative 1806 as a function of a G function. In the illustrated example, the graph 1800 indicates that the closure stress value is approximately 3305 pounds per square inch (psi).

Figure 19:
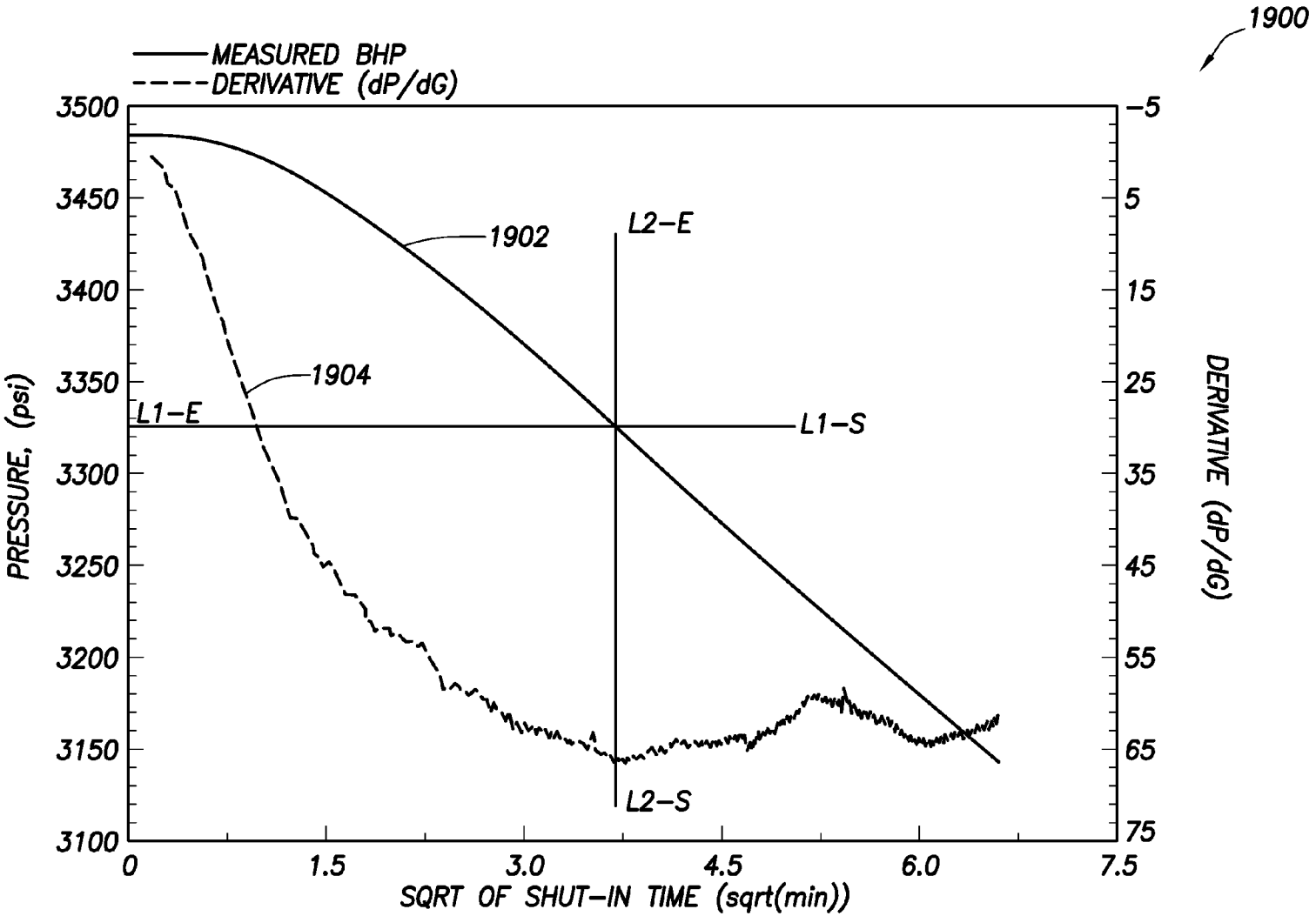
FIG. 19 is a graph depicting an example square root shut-in decline analysis plot according to one or more aspects of the present disclosure.

FIG. 19 shows a graph 1900 depicting an example square root shut-in decline analysis plot according to one or more aspects of the present disclosure. The example graph 1900 includes a plot of the measured bottomhole pressure 1902 and the corresponding derivative 1904, both as a function of the square root of the shut-in time. Using the example graph, the measured closure bottomhole pressure is approximately 3325 psi. Having comparable closure stress values from the two graphs 1800 and 1900 of FIGS. 18 and 19 increases the confidence in the accuracy of the estimated fracture closure stress.

The decline analysis plots may occasionally fail to have a closure signature. For this reason, multiple openings and closures of the fracture are performed to improve the likelihood that a closure signature may be identified from one or more closures.

In view of the foregoing description and the figures, it should be clear that the present disclosure introduces a method of lowering a downhole tool into a wellbore penetrating a subterranean shale formation, logging via the downhole tool, a portion of the wellbore adjacent the shale formation to generate logging results, processing the logging results to select test intervals along the portion of the wellbore, performing a stress test at one or more of the selected test intervals to generate stress test results for the shale formation, and adjusting a model representing at least one property of the shale formation based on the stress test results.

The present disclosure also introduces a system including a logging tool configured to generate logging results associated with a portion of a wellbore adjacent a subterranean shale formation, a processing unit configured to process the logging results to select test intervals along the portion of the wellbore, a stress testing tool configured to perform stress tests at one or more of the selected test intervals to generate stress test results for the shale formation, and a model representing at least one property of the shale formation and stored in a memory, wherein the model is configured to be adjusted based on the stress test results.

The present disclosure further introduces an apparatus including a processor and a memory coupled to the processor, where the memory includes machine readable instructions which, when executed, cause the processor to lower a downhole tool into a wellbore penetrating a subterranean shale formation, log via the downhole tool, a portion of the wellbore adjacent the shale formation to generate logging results, process the logging results to select test intervals along the portion of the wellbore, perform a stress test at one or more of the selected test intervals to generate stress test results for the shale formation, and adjust a model representing at least one property of the shale formation based on the stress test results.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A method comprising:

lowering a downhole tool into a wellbore penetrating a subterranean shale formation;

logging via the downhole tool, a longitudinal portion of the wellbore adjacent the shale formation to generate logging results;

processing the logging results to select test intervals along the longitudinal portion of the wellbore having a relatively low stress level, a relatively low breakdown pressure, or a relatively high horizontal stress anisotropy including determining a test interval sequence to increase a life of the downhole tool, wherein determining the test interval sequence to increase the life of the downhole tool comprises ordering the selected test intervals so that a first one of the selected test intervals associated with a first differential pressure having a lower-stress test intervals across the downhole tool is tested prior to a second one of the selected test intervals associated with a second differential pressure having a higher-stress test intervals across the downhole tool greater than the first differential pressure;

performing a stress test at one or more of the selected test intervals to generate stress test results for the shale formation, wherein performing the stress test comprises determining a closure stress of the shale formation; and adjusting a model representing at least one property of the shale formation based on the stress test results.

2. The method of claim 1 wherein processing the logging results to select the test intervals comprises performing at least one of a petrophysical analysis of the logging results or a cluster analysis of the logging results.

3. The method of claim 1 wherein processing the logging results to select the test intervals comprises identifying areas along the longitudinal portion of the wellbore at which the downhole tool is substantially likely to achieve isolation.

4. The method of claim 1 wherein processing the logging results to select the test intervals comprises processing wellbore images.

5. The method of claim 1 further comprising, prior to performing the stress test at the one or more of the selected intervals and based on the logging results, performing an operation on the longitudinal portion of the wellbore to reduce a breakdown pressure of a portion of the shale formation.

6. The method of claim 1 further comprising predicting a hydraulic fracture height growth based on the adjusted model.

7. The method of claim 1 wherein adjusting the model comprises adjusting an acoustically determined stress profile or strain coefficients associated with the shale formation.

8. The method of claim 1 wherein the downhole tool is configured for conveyance in a wellbore via at least one of a wireline or a drillstring.

9. The method of claim 1, wherein the model comprises a stress model configured to generate a predicted closure stress, and adjusting the model comprises comparing the determined closure stress to the predicted closure stress to calibrate the model.

10. The method of claim 1, wherein processing the logging results to select test intervals comprises arranging the test intervals in order of decreasing stress level, decreasing breakdown pressure, or increasing horizontal stress anisotropy.

11. A system comprising:

a logging tool configured to generate logging results associated with a longitudinal portion of a wellbore adjacent a subterranean shale formation;

a processing unit configured to process the logging results to select test intervals along the longitudinal portion of the wellbore having a relatively low stress level, a relatively low breakdown pressure, or a relatively high horizontal stress anisotropy including determining a test interval sequence to increase a life of the downhole tool, wherein determining the test interval sequence to increase the life of the downhole tool comprises ordering the selected test intervals so that a first one of the selected test intervals associated with a first differential pressure having a lower-stress test intervals across the downhole tool is tested prior to a second one of the selected test intervals associated with a second differential pressure having a higher-stress test intervals across the downhole tool greater than the first differential pressure;

a stress testing tool configured to perform stress tests at one or more of the selected test intervals to generate stress test results for the shale formation, wherein the stress testing tool is configured to determine a closure stress of the shale formation; and a model representing at least one property of the shale formation and stored in a memory, wherein the model is configured to be adjusted based on the stress test results.

12. The system of claim 11 wherein the processing unit is configured to select the test intervals by at least one of performing a petrophysical analysis of the logging results, performing a cluster analysis of the logging results, identifying areas along the longitudinal portion of the wellbore at which the downhole tool is substantially likely to achieve isolation, or processing wellbore images.

13. The system of claim 11 further comprising a coring tool or a perforating gun configured to perform an operation on the longitudinal portion of the wellbore to reduce a breakdown pressure of the portion of the shale formation.

14. The system of claim 11 wherein the stress testing tool is coupled to a wireline tool with dual packers.

15. The system of claim 11 wherein the processing unit is configured to determine a test sequence for the selected test intervals.

16. The system of claim 15 wherein the processing unit is configured to determine the test sequence to increase a life of the stress testing tool, increase a number of test intervals, or based on the logging results.

17. An apparatus comprising: a processor; and a memory coupled to the processor, comprising machine readable instructions which, when executed by the processor, causes the processor to:

lower a downhole tool into a wellbore penetrating a subterranean shale formation;

log via the downhole tool, a longitudinal portion of the wellbore adjacent the shale formation to generate logging results;

process the logging results to select test intervals along the longitudinal portion of the wellbore having a relatively low stress level, a relatively low breakdown pressure, or a relatively high horizontal stress anisotropy including determining a test interval sequence to increase a life of the downhole tool, wherein determining the test interval sequence to increase the life of the downhole tool comprises ordering the selected test intervals so that a first one of the selected test intervals associated with a first differential pressure having a lower-stress test intervals across the downhole tool is tested prior to a second one of the selected test intervals associated with a second differential pressure having a higher-stress test intervals across the downhole tool greater than the first differential pressure;

perform a stress test at one or more of the selected test intervals to generate stress test results for the shale formation, wherein performing the stress test comprises determining a closure stress of the shale formation; and adjust a model representing at least one property of the shale formation based on the stress test results.

* * * * *